US010745192B2

(12) United States Patent
Dunlap et al.

(10) Patent No.: US 10,745,192 B2
(45) Date of Patent: Aug. 18, 2020

(54) INDUSTRIAL BAG DISCHARGE SPOUT

(71) Applicant: AMERIGLOBE, LLC, Lafayette, LA (US)

(72) Inventors: Clifford Dunlap, Baton Rouge, LA (US); Daniel R. Schnaars, Sr., Lafayette, LA (US)

(73) Assignee: AMERIGLOBE, LLC, Lafayette, LA (US)

( * ) Notice: Subject to any disclaimer, the term of this patent is extended or adjusted under 35 U.S.C. 154(b) by 135 days.

(21) Appl. No.: 15/345,452

(22) Filed: Nov. 7, 2016

(65) Prior Publication Data

US 2018/0050863 A1 Feb. 22, 2018

Related U.S. Application Data

(60) Provisional application No. 62/252,270, filed on Nov. 6, 2015, provisional application No. 62/269,087, filed on Dec. 17, 2015.

(51) Int. Cl.
*B65D 88/00* (2006.01)
*B65D 88/16* (2006.01)

(52) U.S. Cl.
CPC ..... *B65D 88/1668* (2013.01); *B65D 88/1681* (2013.01); *B65D 2588/162* (2013.01)

(58) Field of Classification Search
CPC ..... B65D 88/1668; B65D 88/1618; B65D 88/1612; B65D 88/1681; B65D 88/1687;
(Continued)

(56) References Cited

U.S. PATENT DOCUMENTS 2,696,235 A 12/1954 Toffolon
3,443,832 A * 5/1969 Ehlinger ..... B65D 88/1668 294/68.3
(Continued)

FOREIGN PATENT DOCUMENTS

EP 2570365 3/2013
GB 1604213 12/1981
(Continued)

OTHER PUBLICATIONS

PCT International Search Report and the Written Opinion of the Searching Authority for International Application No. PCT/US2014/041154 (dated Nov. 13, 2014).
(Continued)

*Primary Examiner* — Charles Cheyney
(74) *Attorney, Agent, or Firm* — Garvey, Smith & Nehrbass, Patent Attorneys, L.L.C.; Julia M. FitzPatrick; Gregory C. Smith

(57) ABSTRACT

A discharge assembly for use with a flexible bag, e.g., a bulk bag, comprises a discharge spout coupled to a bottom panel of the bag, wherein the discharge spout is configured to be rolled. A releasable flexible fabric tape or tie secures the discharge spout in rolled configuration to the bottom panel to define a closed configuration for the discharge spout. In the closed configuration, material contents of the bag are contained within the bag. When contents of the bag are ready to be discharged, releasing the tape or tie causes the discharge spout to unroll and materials contained in the bag will flow therethrough. A discharge tube cover can also be provided that extends across the bottom panel and discharge tube. The discharge tube cover helps provide a flatter surface for the bag to rest upon, provides another level of closure to help prevent material contents of the bag from leaking, and can provide additional support and strength to the bag.

20 Claims, 13 Drawing Sheets

(58) Field of Classification Search
CPC ..... Y10S 383/906; Y10S 383/904; Y10S 383/907
USPC ..... 222/105, 107, 527, 528; 383/67, 906
See application file for complete search history.

(56) References Cited

U.S. PATENT DOCUMENTS 3,542,032 A * 11/1970 Spencer, Jr. ..... A61F 7/03 126/204
4,143,796 A * 3/1979 Williamson ..... B65D 88/1612 222/181.3
4,211,266 A 7/1980 Massey
4,364,424 A 12/1982 Nattrass
4,408,643 A * 10/1983 Laske ..... B65D 33/24 383/61.1
4,457,456 A * 7/1984 Derby ..... B31D 1/06 141/114
4,865,218 A 9/1989 Derby et al.
4,917,507 A * 4/1990 Davidson ..... B65D 88/1612 383/121
5,340,218 A * 8/1994 Cuthbertson ..... B65D 88/1668 206/600
5,484,207 A * 1/1996 Schnaars ..... B65D 88/1668 383/67
5,536,086 A 7/1996 Nattrass
5,695,598 A 12/1997 Groshens et al.
5,823,683 A 10/1998 Antonacci et al.
6,048,296 A * 4/2000 Futerman ..... B65D 88/1618 493/217
6,076,702 A 6/2000 Hoffmann et al.
6,305,845 B1 10/2001 Navin
6,318,594 B1 * 11/2001 Hutchins ..... B65B 69/0091 222/1
6,374,579 B1 4/2002 Muller
6,467,955 B1 * 10/2002 Kim ..... B65D 88/1612 383/105
6,886,981 B2 * 5/2005 Taniguchi ..... B65D 88/1668 24/30.5 L
6,935,500 B1 * 8/2005 Schnaars ..... B65D 88/1668 206/386
6,935,782 B2 8/2005 Cholsaipant
7,276,269 B2 10/2007 Kraimer et al.
8,297,840 B2 10/2012 Jansen
9,016,521 B2 * 4/2015 Foster ..... B65D 35/40 222/107
2005/0167456 A1 8/2005 Levi
2008/0115458 A1 5/2008 Funaki et al.
2008/0176609 A1 7/2008 Chereau et al.
2009/0260324 A1 10/2009 Funaki et al.
2010/0209025 A1 8/2010 Futase
2011/0019942 A1 1/2011 Piraneo
2011/0085749 A1 4/2011 Frei et al.
2011/0206300 A1 8/2011 Koesters et al.
2012/0227363 A1 9/2012 Nussbaum
2012/0314979 A1 12/2012 Heininga
2013/0202231 A1 8/2013 Nowak et al.
2013/0209002 A1 8/2013 Bazbaz
2014/0360669 A1 12/2014 Schnaars, Sr.
2014/0363106 A1 12/2014 Schnaars, Sr.

FOREIGN PATENT DOCUMENTS

SU 1533636 1/1990
WO 1998/011291 3/1998
WO 2003/032763 4/2003
WO 2012/121716 9/2012

OTHER PUBLICATIONS

PCT International Search Report and the Written Opinion of the Searching Authority of International Application No. PCT/US2014/041155 (dated Sep. 30, 2014).
PCT International Search Report and Written Opinion for International Patent Application Serial No. PCT/US2017/060411 (dated Mar. 15, 2018).

* cited by examiner

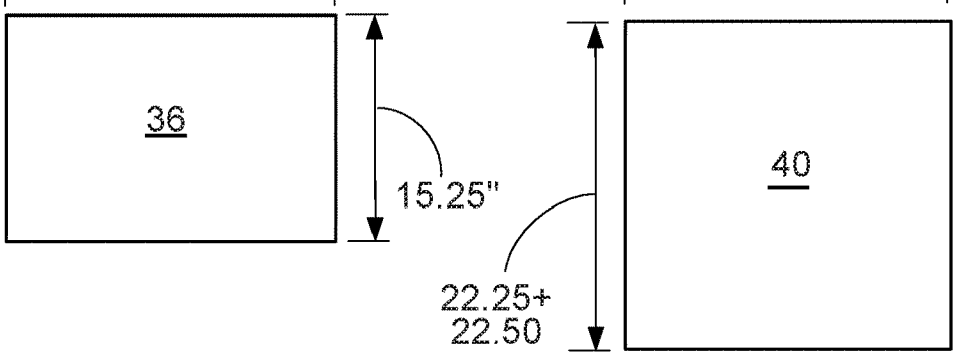
FIG. 15B
FIG. 15C
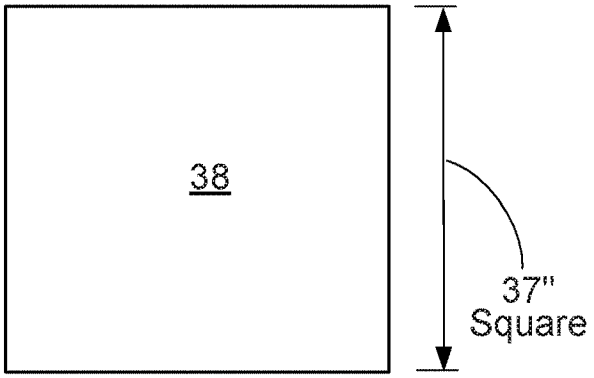
FIG. 15A
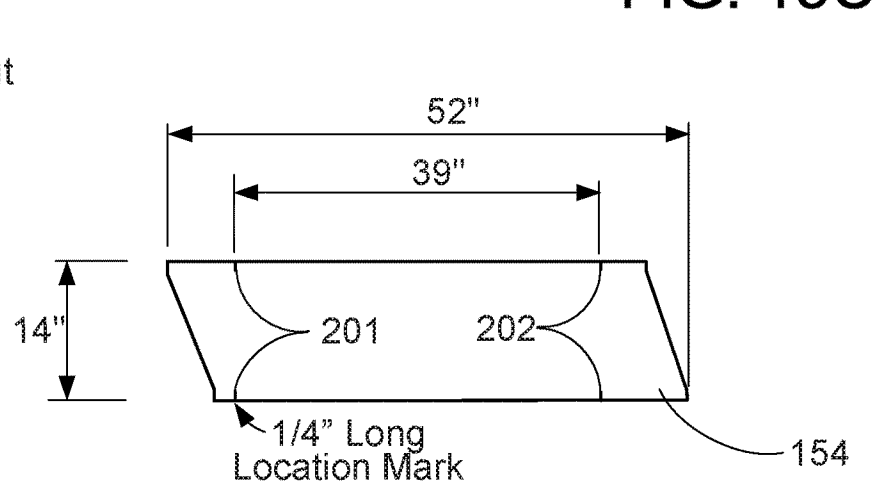
FIG. 15E
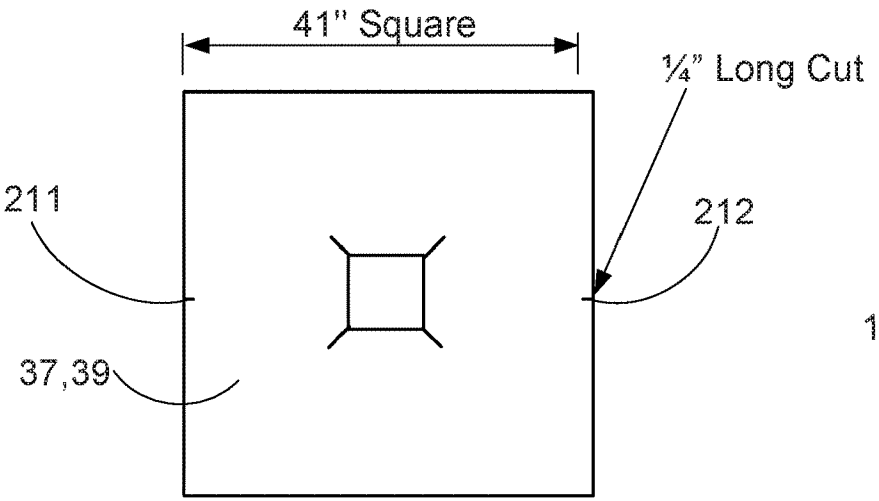
FIG. 15D

INDUSTRIAL BAG DISCHARGE SPOUT

CROSS-REFERENCE TO RELATED APPLICATIONS

This application claims the benefit of and/or priority to U.S. Provisional Patent Application Ser. No. 62/252,270, filed on Nov. 6, 2015, which is hereby incorporated herein by reference.

This application is related to and also claims the benefit of and/or priority to U.S. Provisional Patent Application Ser. No. 62/269,087, filed on Dec. 17, 2015, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

A discharge spout is provided for a bulk bag. The spout is rolled into a closed position and retained by one or more couplers and/or covers releasably coupled across the rolled spout, e.g., by adhesion or heat sealing or fusing. The couplers for retaining the rolled spout may be knot-free. A cover extending from one body side, across a bottom and rolled spout, to an opposing body side, can provide additional support and strength to the bag and provide a flatter bottom surface for the bag.

2. General Background of the Invention

Many industries exist in which large quantities of materials or products must be contained and transported. Such materials or products can be free-flowing, making it necessary to fully support the entire volume of the materials or products. Industries that deal with storing and transporting such dry, flowable products, e.g., sand, fertilizer, granules of plastic, powdered chemicals, carbon black, grains and food products use what are known as flexible intermediate bulk containers, also known as bulk bags, industrial bags, or big bags. The bags are generally made from flexible fabric, typically woven polypropylene or polyethylene. The bags can be assembled from multiple pieces of flexible fabric, and sewn together at stitched joints. Some bags use heat fusion to created joints instead of stitched seams, and reference is made to the following published patent applications of the same inventors, each of which is incorporated herein by reference, for further detail: WO2014/197728, published on Dec. 11, 2014; US2014/0363106, published on Dec. 11, 2014; WO2014/197727, published on Dec. 11, 2014; and US2014/0360669, published on Dec. 11, 2014.

Prior art methods of preventing discharge of material through a discharge spout typically include ropes or other tie straps, or cords to close off discharge spouts. When it comes time to release material contained in the bag, such discharge spouts are opened via untying the rope tie, strap, or cord, or by cutting the tie or rope or strap or cord, for example.

At some point during use of the bulk bag, the contained material must be discharged from the bag.

Knots in any ties, straps or ropes closing off a discharge spout must be untied while under pressure from the materials contained in the bag and such pressure, generally makes knots difficult to untie; the knots often tangle or do not slip open properly. If the knots do not untie properly, the operator must reach under the bag, typically with both hands to untie the knots. Due to the weight of the materials above the knots, the operator is quite often unable to untie the knots. Further, such an effort requires the operator to expose the operator's head, shoulders, and arms underneath the large volume of materials within the bag. The downward forces being applied by the operator to untie the knots increase the risk of unpredictable discharge, or the bag dropping. If the operator cuts the knots to release the materials, then loose pieces of tie can fall into and mix with the materials, causing expensive contamination of the materials or damage to the conveying equipment.

Additionally, although prior art methods of tying off a discharge tube can prevent discharge of all the materials in the bulk bag, some of the materials often leak or sift out the point of closure with the tie.

Prior art discharge tubes also typically are bunched up or folded to one side, during filling of a bulk bag with materials, resulting in a bottom surface of a bulk bag that is not flat and can cause leaning of a bulk bag during transport.

There is thus a need in the art for a discharge assembly that effectively closes off or seals a discharge tube or spout on a bulk bag while it is containing materials, but which enables quick and effective discharge of the materials without risk of contaminating the materials, damaging the equipment, or injuring an operator.

There is also a need in the art for a discharge assembly that helps provide a flatter surface for a bulk bag to rest upon during transport.

BRIEF SUMMARY OF THE INVENTION

One or more embodiments of the apparatus and method of the present invention(s) comprises a discharge assembly for use with a flexible bag, e.g., a bulk bag, comprising a discharge spout coupled to a bottom panel of the bag, wherein the discharge spout is configured to be rolled. A releasable flexible fabric tape or tie preferably secures the discharge spout in rolled configuration to the bottom panel to define a closed configuration for the discharge spout. In the closed configuration, material contents of the bag are contained within the bag. When contents of the bag are ready to be discharged, releasing the tape or tie causes the discharge spout to unroll and materials contained in the bag will flow therethrough. A discharge tube cover can also be provided that extends across the bottom panel and discharge tube. The discharge tube cover helps provide a flatter surface for the bag to rest upon, provides another level of closure to help prevent material contents of the bag from leaking, and can provide additional support and strength to the bag.

In various embodiments a discharge assembly includes a tied off discharge spout and a discharge tube cover.

One or more embodiments include a flexible bag comprising: a body including a bottom panel, and a discharge assembly comprising: a discharge spout coupled to the bottom panel; and a releasable discharge spout coupler coupled to the bottom panel; wherein the discharge spout is configured to be rolled, and the releasable discharge spout coupler is configured to be releasably coupled across and to the discharge spout to maintain a rolled position against the bottom panel.

In various embodiments, the discharge assembly further comprises a cover releasably attachable to the bottom panel across the rolled discharge spout and the releasable discharge spout coupler.

In various embodiments, the releasable discharge spout coupler is knot-free.

In various embodiments, the releasable discharge spout coupler includes an adhesive which releasably secures the discharge spout in a rolled position against the bottom panel.

In various embodiments, the releasable discharge spout coupler coupled to the bottom of the bag and rolled layers prevents release of bulk material from the bag.

Additional embodiments include a flexible bag comprising: a body including a bottom panel; and a discharge portion on the bottom panel, the discharge portion having a closed configuration and an open configuration; the closed configuration of the discharge portion having a plurality of rolled layers releasably secured against the bottom panel of the bag, wherein the plurality of rolled layers secured against the bottom panel prevents discharge of any material in the flexible bag through the discharge portion.

In various embodiments, the plurality of rolled layers are releasably secured against the bottom panel with a releasable coupler positioned on the bottom panel and extending to the plurality of rolled layers in the closed configuration.

In various embodiments, the releasable coupler is positioned on the bottom panel so that it is accessible for removing from the bottom panel without standing under the bottom panel.

In various embodiments, the releasable coupler is releasable from the bottom panel by pulling.

In various embodiments, the releasable coupler is releasable from the bottom panel without untying.

In various embodiments, the discharge portion in an open configuration is not rolled.

In various embodiments, the body has an interior and wherein the discharge portion is in communication with the interior of the body.

In various embodiments, changing the state of the closed configuration to the open configuration is effected by releasing the discharge coupler so that the rolled layers unroll.

In various embodiments, a discharge spout cover is releasably attachable to the bag, said discharge spout cover extending across the rolled discharge portion.

In various embodiments, the discharge spout cover extends from a first body side, across the bottom of the bag and over the rolled discharge portion to a second body side, the cover having a first fold or bend location at which the cover extends across a first bottom edge to the first body side and a second fold or bend location at which the cover extends across a second bottom edge to the second body side, and wherein a distance between the first and second fold or bend locations of the discharge spout cover is shorter than a length of the bottom between the first and second bottom edges.

In various embodiments, the distance between the first and second fold or bend locations is one to two inches shorter than the length of the bottom between the first and second bottom edges.

In various embodiments, the cover coupled to the bag across the discharge portion provides a substantially flat bottom surface for the bag, wherein attachment of the cover causes the rolled discharge portion to push up against the bottom of the bag and raise a portion of the bottom of the bag.

In various embodiments, the cover increases the strength of the bag over 50%. In various embodiments, the discharge assembly in the closed configuration is configured to prevent discharge of 1 to 2 tons of bulk material, or over 200 pounds of bulk material contained in the bag.

In various embodiments, the releasable coupler prevents discharge of 1 to 2 tons of bulk material.

One or more embodiments of the method of the present invention include a method of containing and/or discharging material from a flexible bag comprising:

(a) providing a flexible bag having a body, a bottom, an interior, and a discharge portion having a closed and an open configuration, wherein the body is configured for housing material within the interior and wherein the discharge portion is in communication with the interior via an opening in the bottom, the discharge portion configured to contain material within the interior in the closed configuration and configured to discharge material through the discharge portion in the open configuration;

(b) changing the state of the discharge portion to the closed position prior to filling the flexible bag with material by rolling the discharge portion a distance towards the bottom of the bag to provide a plurality of rolled layers and coupling the rolled layers at or near the bottom of the bag;

(c) filling the flexible bag with material;

(d) changing the state of the discharge portion to the open configuration by releasing the rolled layers from the bottom of the bag and unrolling the rolled layers.

Various embodiments of the method further comprise providing a discharge spout cover releasably attachable to the bag, which extends across the rolled discharge portion and bottom of the bag.

In various embodiments of the method, the cover is positioned on the bag so that it extends from a first body side of the bag across the bottom of the bag and over the rolled discharge portion to a second body side of the bag, wherein the cover has a first fold or bend location at which the first cover extends across a first bottom edge to the first body side and a second fold or bend location at which the cover extends across a second bottom edge to the second body side, wherein a distance between the first and second fold or bend locations is shorter than a length of the bottom between the first and second bottom edges.

In various embodiments of the method, the cover is positioned on the bag so that the distance between the first and second fold or bend locations is one to two inches shorter than the length of the bottom between the first and second bottom edges.

One or more embodiments of a flexible bag with a discharge assembly include: a body including a bottom panel; a discharge portion; and a discharge cover extending across the discharge portion and bottom panel, the discharge cover configured to increase the strength of the bag by at least 50%.

One or more embodiments of a flexible bag with a discharge assembly include: a body including a bottom panel; a discharge portion; and a discharge cover extending across the discharge portion and bottom panel, the discharge cover configured to increase the strength of the bag up to over 50%.

One or more embodiments of a flexible bag with a discharge assembly include: a body including a bottom panel; a discharge portion; and a discharge cover extending across the discharge portion and bottom panel, the discharge cover configured to increase the strength of the bag from 1% to over 50%.

One or more embodiments of a flexible bag with a discharge assembly include: a body including a first body side and a second body side; a bottom including a first bottom edge and a second bottom edge; a discharge portion; and a discharge cover extending from the first body side, across the bottom of the bag and over the discharge portion to the second body side, the discharge cover having a first fold or bend location at which the cover extends across the first bottom edge to the first body side and a second fold or bend location at which the cover extends across the second bottom edge to the second body side, and wherein a distance between the first and second fold or bend locations of the cover is shorter than a length of the bottom between the first and second bottom edges.

In various embodiments, the distance between the first and second fold or bend locations is one to two inches shorter than the length of the bottom between the first and second bottom edges.

In various embodiments, the cover coupled to the bag across the discharge portion provides a substantially flat bottom surface for a filled bag, wherein when the bag is in a position to be filled the cover is under the discharge portion and the cover provides a surface for making contact with another surface, the cover causing the discharge portion to push up against the bottom of the bag and raising a portion of the bottom of the bag.

In various embodiments, the discharge portion includes a closed configuration wherein the discharge portion is closed off via a tie or strap that is wrapped around, or tied around the discharge portion.

In various embodiments, the discharge portion includes a closed configuration wherein the discharge portion is rolled towards a bottom of the bag to provide a plurality of rolled layers and wherein the rolled layers are coupled to the bottom of the bag with a releasable coupler.

In various embodiments, the discharge portion includes a closed configuration wherein the discharge portion is closed off via a tie or strap that is wrapped around, or tied around the discharge portion, and wherein the cover pushes the discharge portion up against the bottom of the bag while the discharge portion is in the closed configuration.

In various embodiments, the discharge portion includes a closed configuration wherein the discharge portion is rolled towards a bottom of the bag to provide a plurality of rolled layers, wherein the rolled layers are coupled to the bottom of the bag with a releasable coupler, and wherein the cover pushes the discharge portion up against the bottom of the bag while the discharge portion is in the closed configuration.

In one or more embodiments, a discharge assembly of the present invention comprises a discharge tube configured to be rolled, the discharge tube coupled to a bottom of a bag and in communication with an interior of the bag, the discharge tube having a closed configuration and an open configuration, wherein in the closed configuration the discharge tube is rolled towards the bottom of the bag, and wherein a releasable coupler couples the discharge tube to the bag bottom, and wherein in the open configuration, the discharge tube is not rolled.

In various embodiments to effect change from a closed configuration to an open configuration the releasable coupler is removed to release the rolled discharge tube from the bottom of the bag.

In various embodiments to effect change from an open configuration to a closed configuration, the discharge tube is rolled up towards the bottom of the bag.

In various embodiments to effect change from an open configuration to a closed configuration, the discharge tube is rolled up towards the bottom of the bag and coupled the bag with a releasable coupler.

In various embodiments the releasable coupler couples the rolled discharge tube to the bag bottom via an adhesive.

In various embodiments the releasable coupler couples the rolled discharge tube to the bag bottom via heat fusion.

In various embodiments, a cover is provided extending from one bag body or intermediate panel side, across the bag bottom and rolled discharge tube, to an opposing bag body or intermediate side.

One or more embodiments of a discharge assembly include a discharge tube that can be rolled, or tied to effect a closed configuration, and a cover extending from one bag body or intermediate panel side, across the bag bottom and closed discharge tube, to an opposing bag body or intermediate side.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 15A-15E illustrate views of fabric pieces for a body, fill tube, discharge tube, top, bottom and cover.

DETAILED DESCRIPTION OF THE INVENTION

Figure 1:
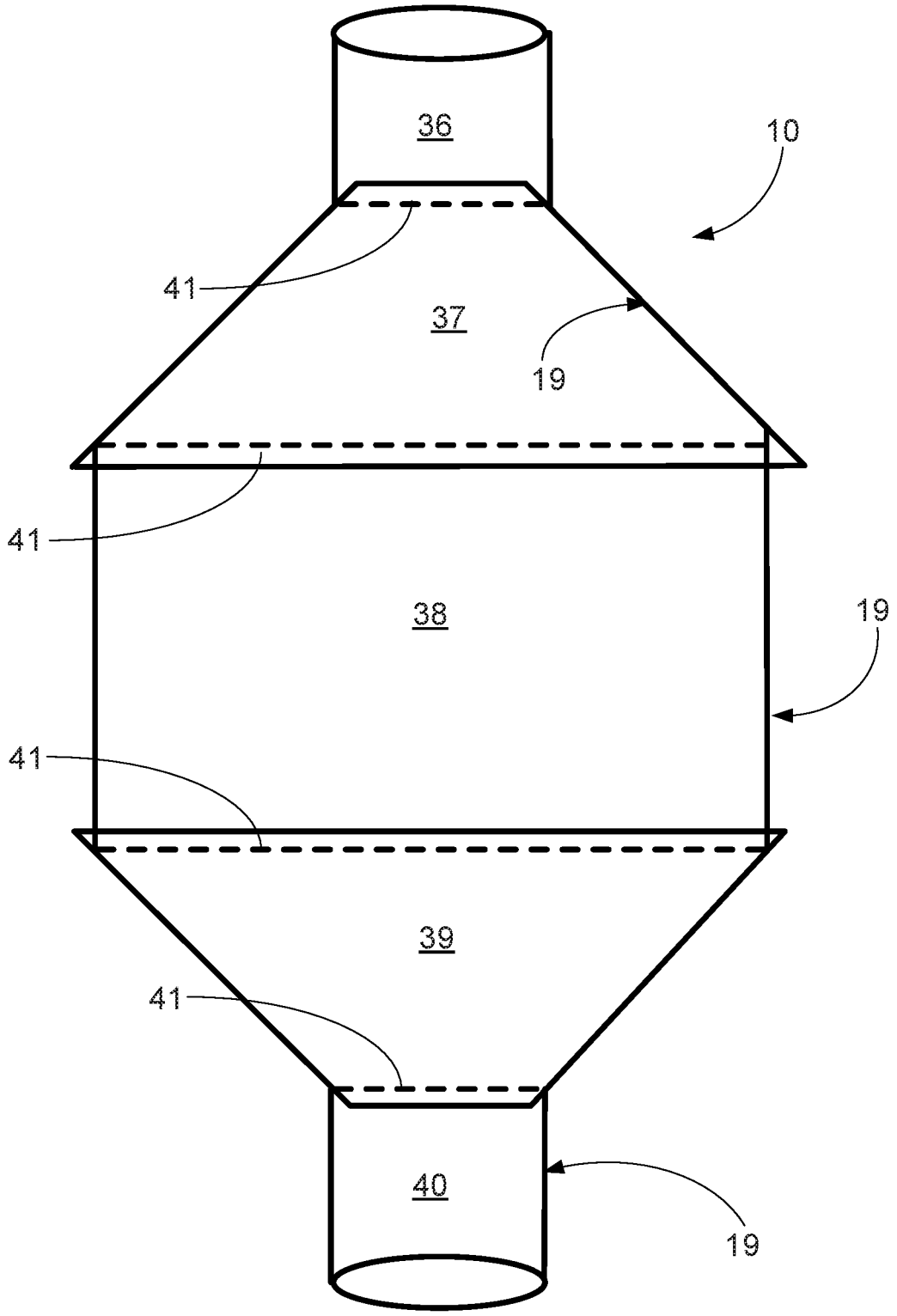
FIG. 1 is a schematic side view of a preferred embodiment of a bulk bag that may be utilized with one or more preferred embodiments of a discharge assembly of the present invention.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein.

It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ".

Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic figure of a bulk bag 10. The bulk bag 10 is a large bag that can carry one to two tons of materials, and in some cases more than 2 tons of material (e.g., 4,000 to 5,000 pounds of material), from one location to another. The discharge assemblies as described and shown herein can be used with such bulk bags, or can also be used with smaller bags, e.g., bags that are designed to carry 15 to 80 pounds of bulk material.

The bag 10 can be filled with materials by gravity, for example, fed through a top spout 36. The top spout 36 can be coupled to an upper portion 37 at a seam or joint 41, which may be sewn, heat fused or heat sealed, or connected by other means. The upper portion 37 can be coupled to an intermediate portion 38 at another joint or seam 41. (Unless otherwise noted, all joints or seams 41 can be sewn, heat fused, or connected by other means as discussed above). At a lower end of the intermediate portion or body 38, a lower portion or bottom 39 can be coupled at another joint or seam 41. Finally, at a lower end of the lower portion or bottom 39, a bottom or discharge spout 40 can be coupled at another joint or seam 41. Various inner and outer surfaces of the bulk bag 10 and its components as described above may include a coating or lamination 19. The coating or lamination can be a standard polypropylene fabric coating (e.g., a coating comprising a majority percentage of polypropylene and a small percentage of polyethylene) or a standard polyethylene fabric coating (e.g., a coating comprising polyethylene, or a mixture of polyethylene and other additives).

In bags including heat fused joints or seams, some surfaces of a bulk bag 10 as described herein and its components preferably include a fusion coating which may be used in bonding, while other surfaces include a standard polypropylene fabric coating or standard polyethylene fabric coating (depending on whether the bag fabric is polyethylene or polypropylene). A fabric piece with a heat fusion coating facing another fabric piece with a heat fusion coating can be joined to form a joint 41 by adding heat and pressure. A fabric piece with a heat fusion coating facing a fabric piece with a standard polypropylene fabric coating for example, can also be joined to form a joint 41 by applying heat and pressure. Reference is made to patent publication numbers WO2014/197728, US2014/0363106, WO2014/197727, and US2014/0360669, incorporated herein by reference.

A fusion coating preferably comprises propylene based elastomers, propylene based plastomers or a combination thereof. More preferably, the coating comprises about 50% to 90% of propylene-based plastomers, propylene-based elastomers, or mixtures thereof and about 10% to 50% polyethylene resins and additives, having a melting point that is preferably at least about 5 degrees lower than the melting point of the fabrics to be joined together. Most preferably the coating comprises about 50% to 90% of VERSIFY™ 3000 and about 10% to 50% polyethylene resins, having a melting point that is preferably at least about 5 degrees lower than the melting point of the polypropylene fabrics to be joined together. Suitable propylene based elastomers or plastomers can be purchased for example under the trademark VERSIFY™ 3000, and EXXON™.

Portions 37, 38, and 39 may sometimes together be referred to herein as a containment area or body of the bag 10. Intermediate portion 38 may also be referred to as a body panel or body portion of the bag 10.

The bulk bag 10 can be emptied by gravity, or via other suitable discharge means, through a discharge spout 40. Before discharge, the spout 40 is preferably closed in such a manner that the contained materials are prevented from discharging until the bag 10 is properly positioned over a receiving hopper or other desired receptacle.

Figure 2A:
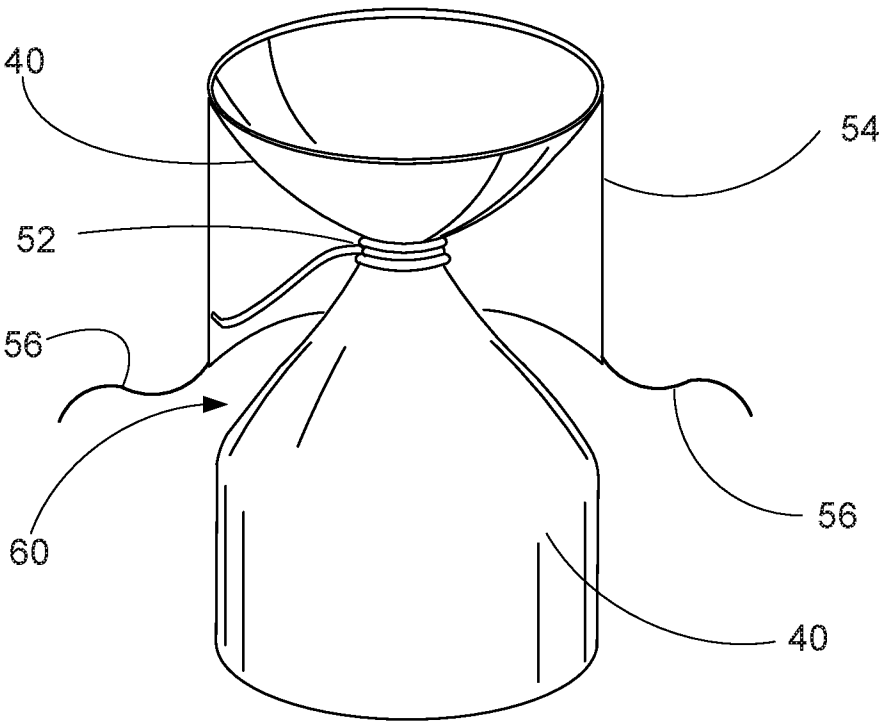
FIG. 2A is a prior art perspective view of the discharge tube and cover shown in FIG. 2.
Figure 2:
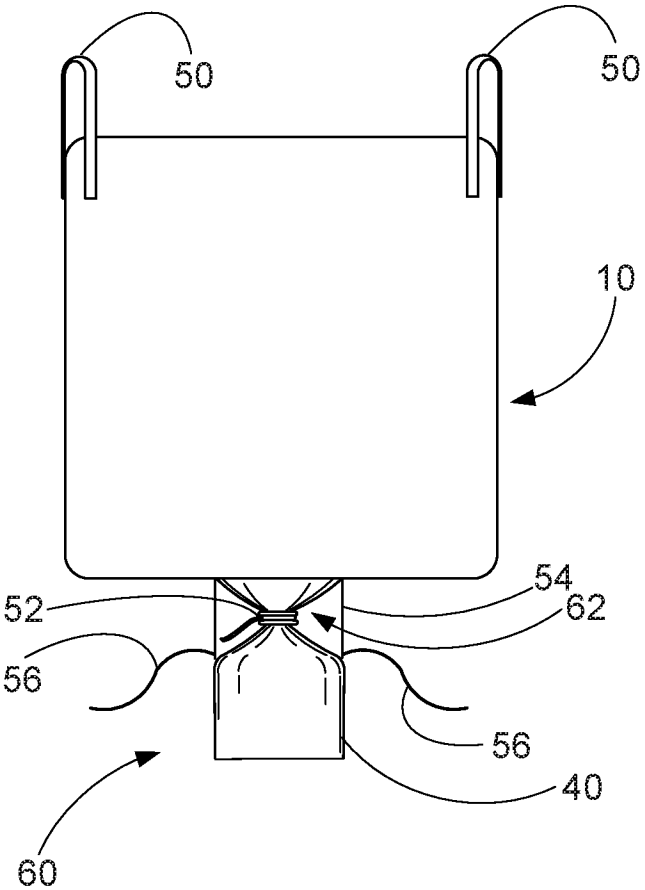
FIG. 2 is a prior art schematic side view of a bulk bag including a tied off discharge tube and a cut away view of a discharge cover with a drawstring tie.

Referring now to FIGS. 2, 2A a prior art discharge assembly 60 is shown. A discharge spout 40 is gathered, bunched and pinched at a pinch point 62. The fabric is generally pinched tightly enough to prevent passage of material at the pinch point 62. The pinch point 62 is then maintained by wrapping or tying a discharge spout tie 52 around the pinch point 62. An outer cover 54, which can be hand tied with a cover tie or cord 56, can be provided. In the prior art embodiment as shown, when tying the cover 54 in place around the discharge tube 40, the tied off discharge tube 40 would be folded up against the bag. The figures show a cutaway view of the cover which includes a tie or cord 56, e.g., a drawstring tie, that can be pulled and tied off to effect closure of the cover over the discharge spout, e.g., after folded in half. The prior art discharge cover does not extend across an entire width of the bag bottom from one side to an opposing side. In the embodiment of a prior art discharge assembly 60 as described above, to change from a closed configuration to an open configuration during discharge, the knots in the tie 56 first must be untied while under pressure from the materials contained in the bag 10, or will need to be cut or otherwise removed. Knots in ties 52 will also need to be untied, while under pressure from the material contents of the bag. Such pressure, generally makes knots difficult to untie; the knots often tangle or do not slip open properly. If the knots do not untie properly, the operator must reach under the bag 10 with both hands to untie the knots. Due to the weight of the materials above the knots, the operator is quite often unable to untie the knots. Further, such an effort requires the operator to expose the operator's head, shoulders, and arms underneath the large volume of materials within the bag 10. The downward forces being applied by the operator to untie the knots increase the risk of unpredictable discharge, or the bag 10 dropping. If the operator cuts the knots to release the materials, then loose pieces of tie can fall into and mix with the materials, causing expensive contamination of the materials or damage to the conveying equipment.

Figure 3A:
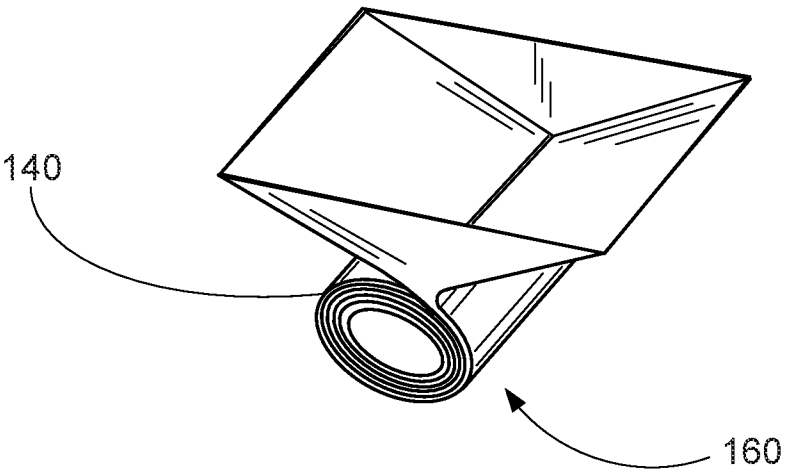
FIG. 3A is a perspective view of the discharge assembly shown in FIG. 3.
Figure 3:
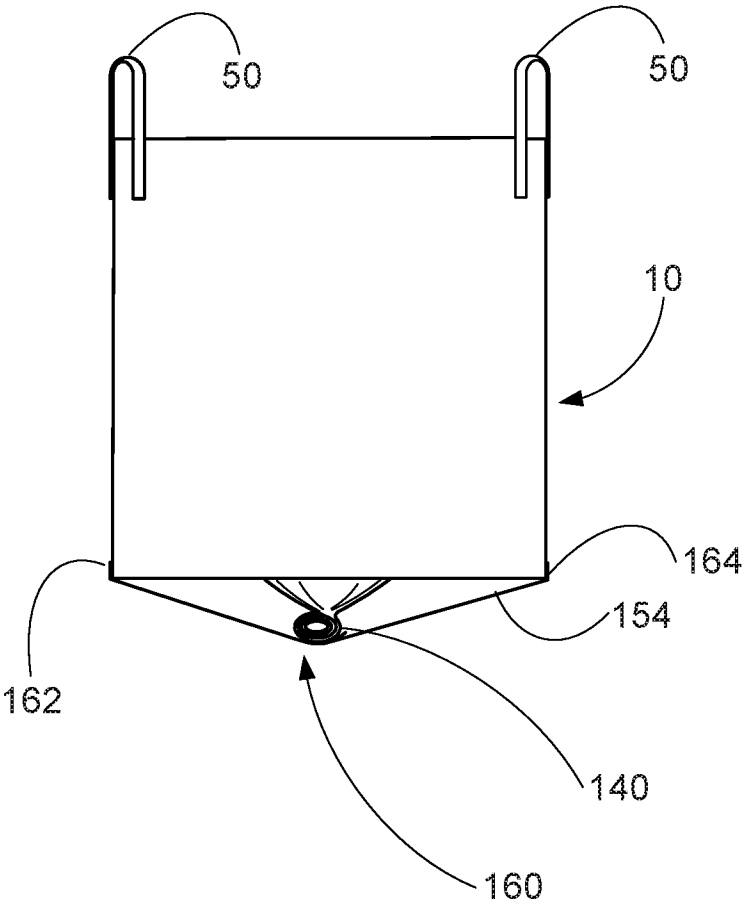
FIG. 3 is a schematic side view of a bulk bag including a preferred embodiment of a discharge assembly.

Referring now to FIGS. 3, 3A, a preferred embodiment of a discharge assembly 160 of the present invention is shown. Discharge assembly 160 on a bulk bag 10 eliminates problems associated with having to untie ties or knots on a cover and a discharge portion that is under pressure from material contents of the bag. Discharge assembly 160 preferably includes a discharge spout 40 rolled into a rolled configuration to define a rolled spout 140, and a releasable discharge spout coupler 152, which can be a tie or tape, e.g., fabric tape including an adhesive that preferably is not solvent based and wherein the adhesive remains active. Discharge spout coupler 152 will sometimes be referred to herein as tie or tape 152.

In some embodiments the discharge assembly 160 also includes a cover 154. Discharge spout 40 can be gathered or rolled toward the bottom of the bag 10. When rolled, the discharge spout 40 has a plurality of rolled layers 148 and forms a rolled discharge spout 140. To maintain a rolled position adjacent the bottom of the bag 100, a releasable discharge spout coupler 152 can be applied. In some embodiments, the discharge spout coupler 152 is an adhesive material, such as adhesive fabric tape, that can adhere to both rolled spout 140 and the bottom of the bag 10 to capture the rolled spout 140. Preferably the adhesive fabric tape is a polypropylene fabric with an adhesive that is not solvent based, and remains active. Other fabric tapes with an adhesive may also be used. The rolled spout 140 coupled to the bottom 39 provides a closed configuration of discharge tube 140, which prevents discharge of materials from the bag. The rolled layers can also help prevent unwanted sifting of materials from the bag.

In some embodiments a cover 154 is included as part of discharge assembly 160 and preferably is disposed across the rolled spout 140 that is coupled to the bottom 39 of the bag via tie or tape 152. Cover 154 can be attached to the bag 100 at couplings 162, 164. Couplings 162, 164 can attach the cover 154 at two sides of body 38, e.g., at two opposing sides. Preferably cover 154 is releasably attached to the bag 100. In some embodiments, the couplings 162, 164 include adhesives, while in other embodiments the couplings 162, 164 include heat fusion. In some embodiments, the pressure from the cover 154 helps maintain the rolled and tied spout 140 in position.

For discharge, if a cover 154 is part of discharge assembly 160, the cover 154 is first released from the bag. In some embodiments cover 154 can be released by peeling or detaching one or both couplings 162, 164. The rolled spout 140 can then be released by peeling or detaching the tie or tape 152 coupled across the spout 140. In this manner, an operator's hand is away from any material flow. An operator preferably can access both the cover 154 and the tie or tape 152 while positioned beside the bag and not standing under the bag. As the tie 152 is peeled or detached, the rolled layers 148 of rolled spout 140 automatically unrolls wherein materials flow easily from the bag 10. Preferably peeling or detaching tie 152 causes the rolled layers 148 to unroll and changes the closed configuration of the discharge tube to an open configuration. Preferably no knots are used in the discharge assembly 160, thus no knots need to be untied. Consequently, the discharge assembly 160 of the bag 10 can also be called knot-free.

Figure 11:
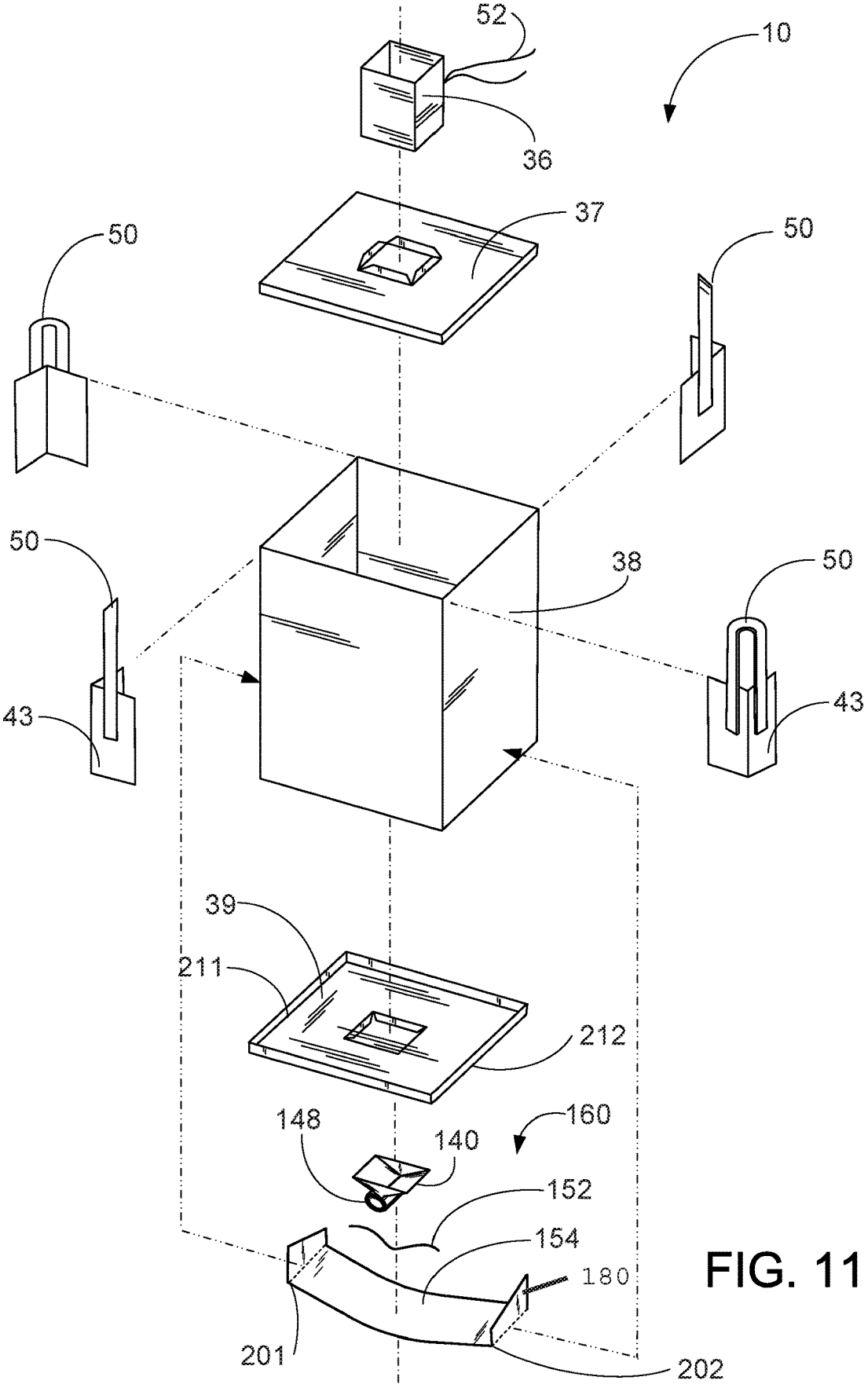
FIG. 11 is an exploded view of a bulk bag including a discharge assembly as shown in FIGS. 3 and 3A and an embodiment of a cover as shown in FIGS. 7-9.

FIG. 11 illustrates a bag 10 in exploded view including rolled discharge tube 140 with tie or tape 152 and cover 154. The bag 10 as shown also has a fill tube 36, top 37, body or intermediate portion 38, and bottom 39. Lift loops 50 can also be provided. In the embodiment as shown the lift loops 50 can be sewn or otherwise attached to patches 43, which are preferably heat fused to body portion 38, or attached to body portion 38 with via other means, e.g., sewing.

Figure 4:
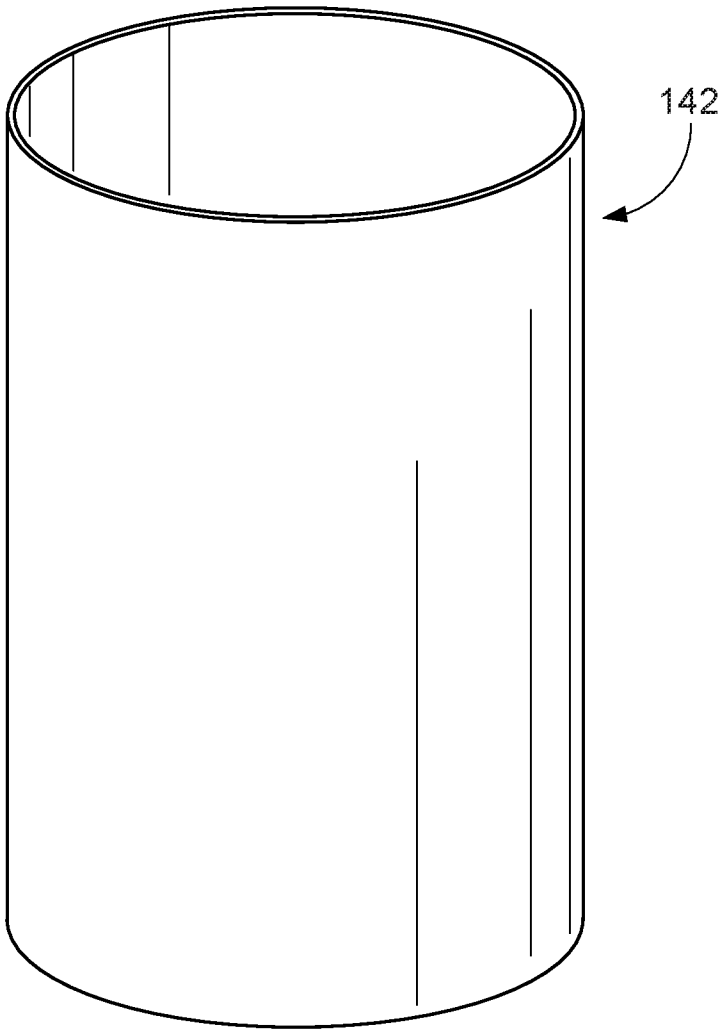
FIG. 4 is a schematic perspective view of a circular or cylindrical discharge spout.

Referring now to FIG. 4, in some embodiments, the spout 40 for use in assembly 160 can be a substantially circular discharge spout 142. The circular discharge spout 142 may include, for example, about a 14-inch diameter. Such a circular discharge spout 142 will flatten out, for purposes of rolling, to about 22 inches. The cover 154 for the circular discharge spout would then preferably be about 23-24 inches wide, for example.

Figure 5:
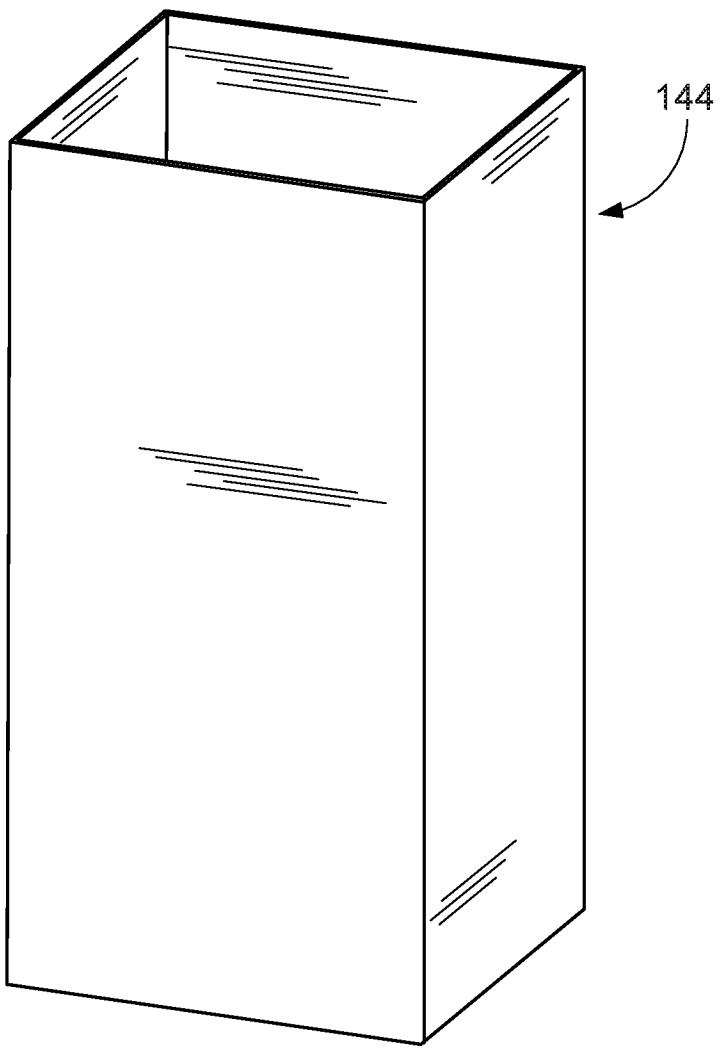
FIG. 5 is a schematic perspective view of a square discharge spout.

In other embodiments, as shown in FIG. 5, the spout 40 can be a substantially square or rectangular spout 144, which can be folded in a gusseted configuration. A folded square or gusseted spout 144 can include gussets 146, e.g., see FIG. 12A. By gusseting the discharge spout 144 first, it is easily rolled up from its open end to at or near the bottom of the bag 100. The square, gusseted spout 144 will flatten out, for purposes of rolling, to about 11 inches wide, for example. The corresponding cover 154 for the square, gusseted spout 144 would preferably be about 12-13 inches wide, for example. FIG. 12B also shows top 37 or bottom 39 in folded, gusseted configuration. FIG. 12C depicts body 38 in folded gusseted formation.

In various embodiments of a rolled spout 144, the multiple, stacked or rolled layers (for example, see layers 148 of FIG. 6) of the rolled spout 144, prevent any materials from leaving the bag 100 prematurely. By securing the rolled spout 144 by supporting it from the bag above, as described above, the spout 144 cannot open until released. The tie or tape 152 coupled to the bottom of the bag 10 and to the rolled tube or spout 140 secures the rolled spout 140 to the bottom 39 of bag 10 and prevents discharge of material contents from the bag. The single piece of tape 152 coupled to the bottom of the bag and rolled tube 140 can prevent 1,000 to 5,000 pounds of bulk material, for example from discharging from the bag.

Figure 6:
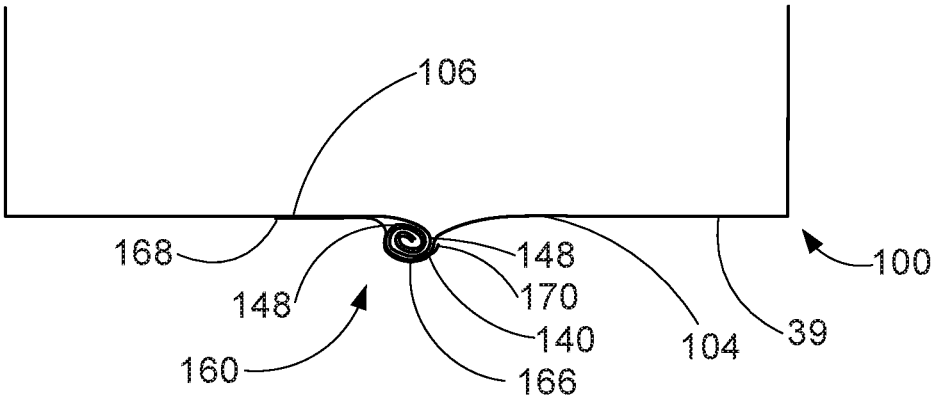
FIG. 6 is an enlarged view of the discharge assembly of FIG. 3 including a spiraled rolled spout retained by a releasable coupler.

Referring next to FIG. 6, the rolled discharge spout 140 is shown attached to a bottom panel 39 of the bag 10, such as by sewing or heat sealing or heat fusion at locations 104, 106. The spout 140 is then rolled up from the loose, bottom end in a tight spiral forming stacked or rolled layers 148 of the rolled spout 140. The tight spiral is preferably rolled until the roll is centered up against the bottom panel 39 or near the bottom panel. In some embodiments, an adhesive tape 152 is applied at location 168, such as two inches outside of the spout coupling 106, for example. The adhesive tape 152 is then applied to extend across the gap to the spiral rolled spout 140.

In some embodiments, a coupling 166 of the adhesive tape 152 does not wrap completely around spiral rolled spout 140, from one location on the bottom 39 to another location on bottom panel 39. For example, a coupling 166 of the adhesive tape 152 to the spiral rolled spout 140 can be applied approximately two-thirds of the way around the rolled spout 140 as shown in FIG. 6.

Figure 7:
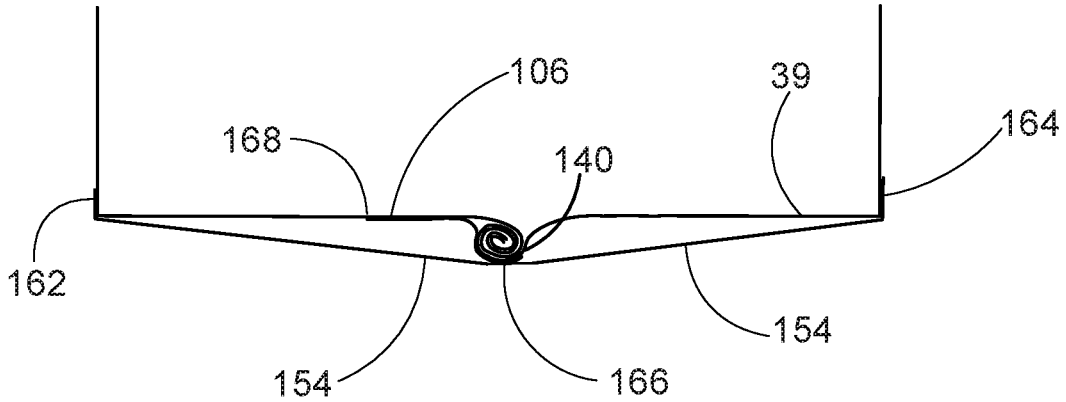
FIGS. 7 and 8 are the discharge assembly of FIG. 6 further including a releasable cover.
Figure 8:
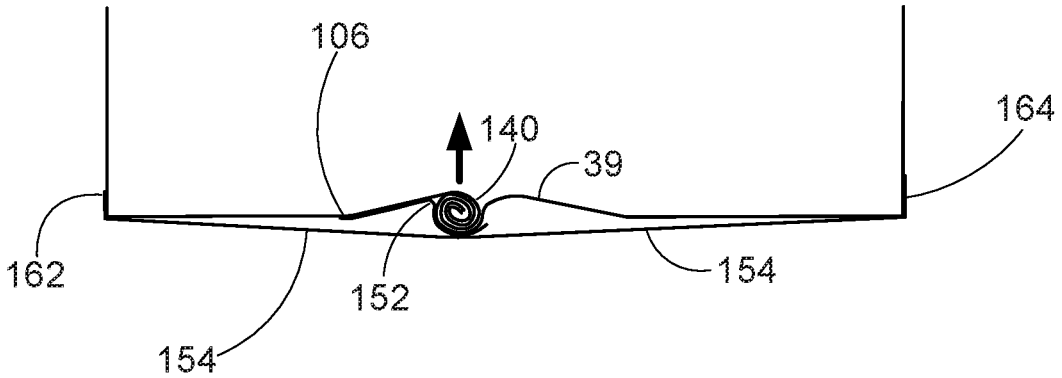

In some embodiments, the end of the adhesive tape 152 is folded back on itself to form a release tab 170. When the bag 100 is ready to be discharged, the tab 170 is pulled, peeling back the adhesive tape 152 until it clears the spiral rolled spout 140 and releases the contained materials. Referring now to FIG. 7, the cover 154 is preferably applied across the rolled and retained spout 140 and adhesive tape or coupler 152, the cover being coupled to body portion 38 at releasable couplings 162, 164. As shown in FIG. 8, the spiral rolled and retained spout 140 can be compressed up into or against the bottom of bag 100 such that a portion of the bottom panel 39 is pushed upward and the bottom surface of the bag 100 at the cover 154 is made flatter for transport.

In some embodiments, the cover 154 is shorter in length, e.g., about 2 inches shorter, than the length required to cross the bottom panel 39 of the bag 100 and has a sealable area. For example, the distance between a fold or bend line 201 and 202, on cover 154 can be shorter than the distance between edge 211 and edge 212 on bottom 39, wherein the cover 154 is coupled to the bag at or near its fold or bend line 201 and bottom edge 211, and cover 154 is also coupled to the bag at or near its fold or bend line 202 and bottom edge 212. Thus cover 154 can extend from a first body 38 side, across bottom 39 of bag 10 and over rolled discharge tube 140 to a second body 38 side, the cover having a first fold or bend location 201 at which the cover can extend across a first bottom edge 211 to the first body 38 side and a second fold or bend location 202 at which the cover can extend across a second bottom 39 edge 212 to a second body 38 side.

When cover 154 is coupled to bag 10 as described above, the shorter distance between the fold or bend locations 201, 202 as compared to the distance between edges 211 and 212 in effect cinches the bag bottom. In such a configuration the cover provides support for the spiral rolled spout 140. Such support can help the spout 140 to pass the required five to one lifting safety margins in bags having material contents of about 1,000 pounds to 5,000 pounds for example, in a bag with heat fused joints. Such cover also provides additional support for the bag 10 bottom 39.

Figure 9:
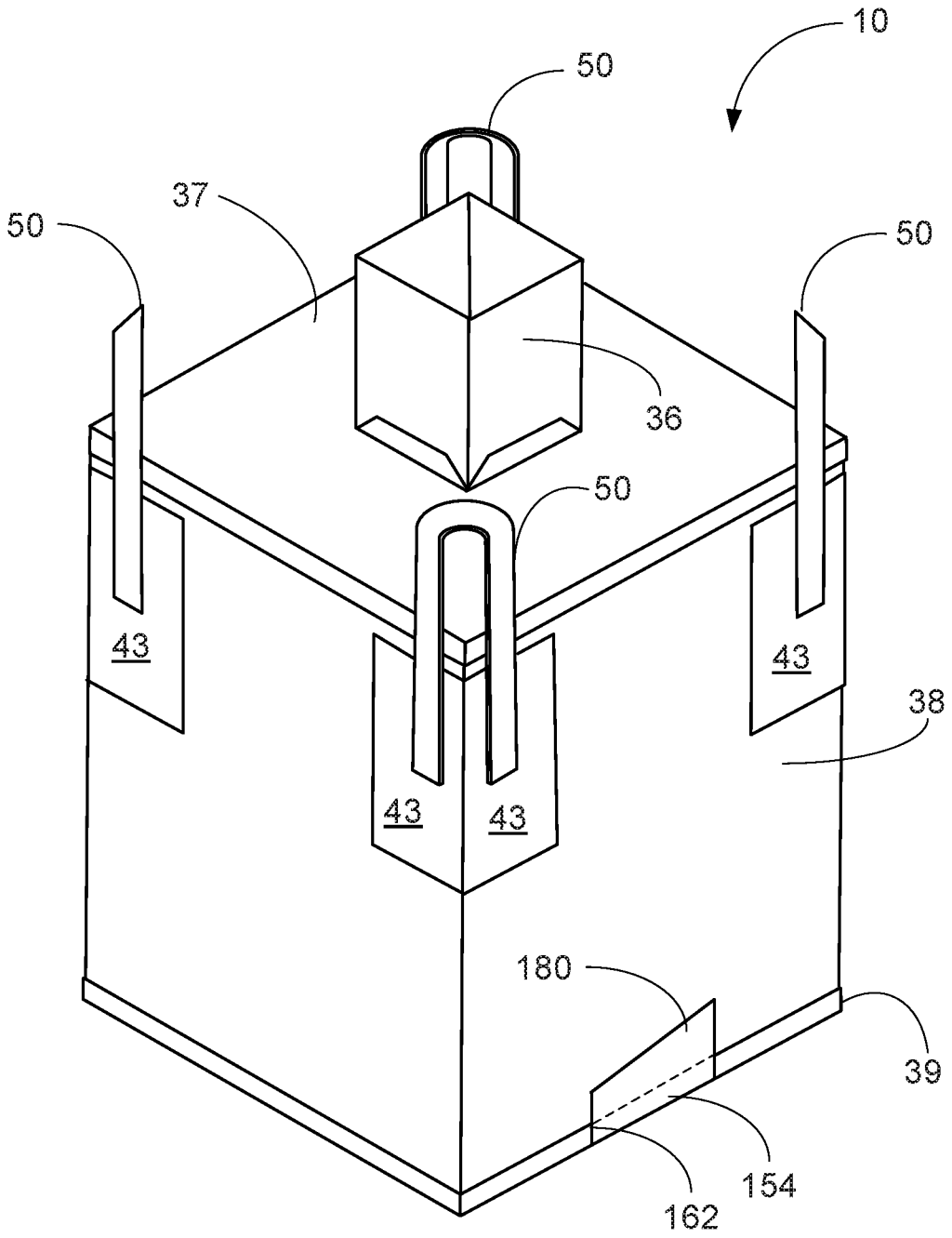
FIG. 9 is a front perspective view of a bulk bag including the cover of FIGS. 7 and 8.

Referring now to FIG. 9, a bag 10 includes an installed or coupled cover 154 of FIGS. 7 and 8 is shown. The cover 154 preferably extends across the bottom panel 39, and is releasably coupled at the coupling 162, extending from a first body 38 side across the bottom over rolled spout 140 to an opposing body 38 side at coupling 164 (not shown). Preferably an unattached area or tab 180 is provided, which can be a pull tab to peel the cover 154 from the side of the bag 10 for releasing the cover 154 away from the bottom of the bag 100 and rolled spout 140.

Thus, as described above, a bulk bag 10 preferably includes a discharge spout 40 to be spiral rolled into position up against, adjacent or near the bottom panel 39 of the bag 10 to form a rolled spout 140. To retain the spiral rolled spout 140 in closed position, e.g., against the bottom panel, a first releasable coupler 152 is coupled to the bottom panel 39, across the spout 140, and coupled to the spout 140. The first releasable coupler 152 is preferably attached or coupled with adhesive or heat sealing, thus it is knot-free. A second releasable coupler, or cover, 154 may also be releasably coupled over the spiral rolled and retained spout 140 with adhesive or heat.

Consequently, the spiral rolled spout 140 is maintained in rolled position, and can easily be released by pulling, peeling, or otherwise releasing the couplers in a knot-free manner. The spiral rolled spout 140 can easily and safely be released by pulling, peeling, or otherwise releasing the couplers in a knot-free manner while under pressure from the material contents of the bag.

Figure 10:
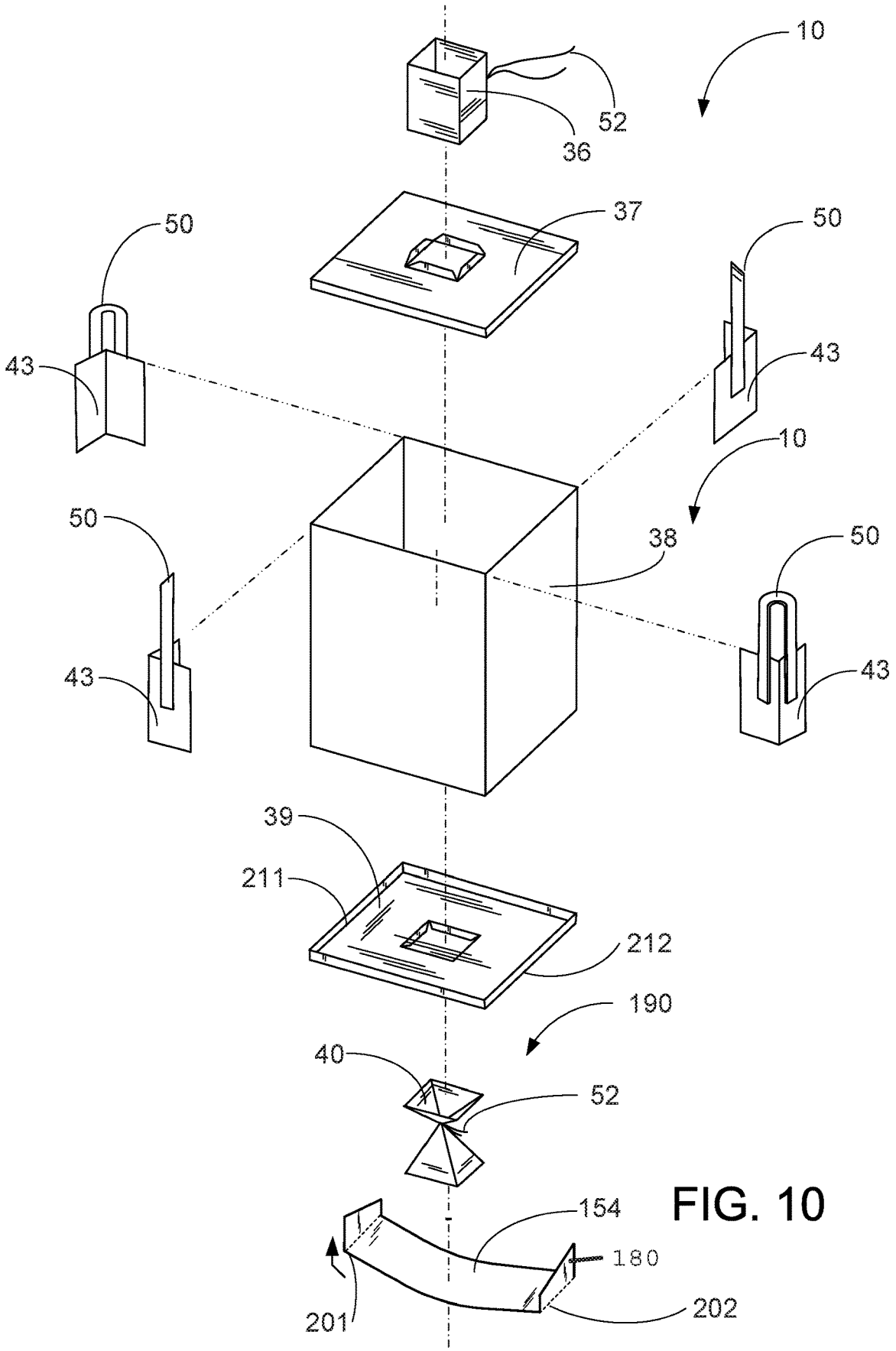
FIG. 10 is an exploded view of a bulk bag including a discharge assembly as shown in FIGS. 2 and 2A and an embodiment of a cover as shown in FIGS. 7-9.

Referring now to FIG. 10, an alternative embodiment of a discharge assembly 190 is shown. In this embodiment, a bulk bag 10 includes a discharge spout 40 that can be closed or pinched off with a tie or tape or cord 52, e.g., in a manner that is the same or similar to what is shown and described with regard to FIGS. 2, 2A. Typically after being closed or pinched off and tied, the discharge tube 40 is then folded against the bag bottom, e.g., folded in half against the bag bottom, for storage or transport, prior to filling with materials. Cover 154 can be the same as a cover 154 as described with regard to discharge assembly 160. The installed outer cover 154 can make the bottom surface of the bulk bag 10, including the discharge assembly 190, flatter for transport. The bulk bag 10 can then be filled and shipped to an end use location.

As shown in FIG. 10, in discharge assembly 190, cover 154 preferably extends from one side of a body or intermediate portion 38 of the bag across the bottom 39 and over the discharge tube 40, to another side of a body or intermediate portion 38 of the bag. In some embodiments the cover 154 can be heat fused to opposing sides of the bag body to couple the cover to the bag body or intermediate portion 38. Preferably cover 154 is releasably attached to the bag body 38, in the same or a similar manner as described with regard to discharge assembly 160, and wherein pulling on tab 180 from a side of the bag can effect release of the cover 154.

A bag 10 with a discharge assembly 190 is shown in an exploded view in FIG. 10, and has a fill tube 36 with a tie or cord 52, top 37, body or intermediate portion 38, bottom 39 and discharge tube 40 with a tie or cord 52 thereupon. In the embodiment as shown, lift loops 50 can be sewn or otherwise attached to patches 43, which patches 43 are preferably heat fused to body portion 38. Patches 43 may also be attached via sewing, for example.

The bulk bag 10 can then be filled and shipped to an end use location. The bag 10 is ultimately lifted over a receiving hopper or other receptacle and prepared for discharging. For lifting, the bag 10 may be provided with lift loops 50.

A tie 52 can be a rope or a woven fabric tie. In some embodiments, a slip knot is hand tied into the rope or woven fabric to complete the discharge spout tie 52.

In the embodiment of a discharge assembly 190 as described above, to change from a closed configuration to an open configuration during discharge, tab 180 of cover 154 can be pulled to effect release of the cover, which preferably can be done from the side of the bag without requiring an operator, or an operator's hand(s) or arm(s) to go under the bag. The tie or cord 52 will then still need to be untied or otherwise removed while under pressure from the materials contained in the bag 10. This embodiment is an improvement over the prior art embodiment as shown in FIGS. 2, 2A because only the tie or cord 52 on discharge tube 40 will need to be untied or otherwise removed. A tie or cord 52 on a discharge tube generally is easier to untie or otherwise remove, than a tie 56 on a discharge cover as shown and described with regard to FIGS. 2, 2A. Additionally, in this embodiment the cover can be removed without having reach under the bag, and can be removed while standing beside the bag.

A cover 154 as described with regard to embodiments 160, 190 of a discharge assembly is an improvement over prior art covers because it extends across an entire width of the bottom of a bag, makes a bag bottom surface flatter for transport, makes a bag bottom surface cleaner and helps prevent any unwanted leakage from the bag, and provides more support for the bag. A cover 154 as described with regard to embodiments 160, 190 of a discharge assembly is also an improvement over prior art covers because it provides additional support for a bag.

A cover 154 as shown can include tab portions 180 and comprise the shape as shown. A cover 154 can also comprise more of a spherical shape, e.g., oval or circular, or can be substantially rectangular, for example. A cover may also be square, but preferably less material is used for a cover, as a cover does not need to completely cover the bottom of the bag in order to provide the advantages described herein.

As indicated herein, a discharge assembly 160, 190, can be used with a bag that has sewn seams and/or has heat fused seams, or which has seams or joints otherwise connected. In embodiments where there are sewn or heat fused seams, the distance between fold or bend locations 201, 202 of a cover 154 can be about equal to a width of the bag bottom, e.g., about equal to a width between edges 211 and 212. The distance between folds or bends 201 and 202 can also be shorter than the distance between edges 211 and 212. For example the distance between folds or bends 201 and 202 can be any distance that is less than equal to the distance between bottom edges 211 and 212, e.g., a distance shorter than equal to about 4 inches shorter than the distance between bottom edges 211, 212.

When a bag 10 has heat fused joints, or at least a heat fused joint connecting a discharge tube 40 and bottom 39, preferably the distance between folds or bends 201 and 202 is two inches shorter than the distance between bottom edges 211, 212. When the distance between folds or bends 201 and 202 is any distance shorter than equal to the distance between edges 211, and 212 the bottom cover provides additional support and strength to the discharge assembly and bag. By having a shorter distance between the folds or bends, it causes an uplift to the bottom of the bag. When a cover 154 is in place as shown in the figures, pressure applied to joints of a bag at the bottom and discharge tube locations, from material contents within the bag must overcome and stretch the cover in order to cause a failure of said joints. As the distance gets closer to 4 inches shorter or more than 4 inches shorter that the distance between edges 211 and 212, the bottom surface of the bag gets more and more pinched and lifted up, and becomes more uneven. The joints of the bag also start to become stressed.

Regarding discharge assemblies 160 and 190, when a bag has a bottom and discharge tube that are connected with a heat fused joint a cover 154 provides additional strength allowing the bag to pass the required 5 to 1 safety requirements in the industry.

A rolled discharge tube assembly 160 with a cover 154 having a distance between cover 154 folds or bends 201 and 202 that is about equal to the distance between edges 211 and 212 has passed the required 5 to 1 safety tests. A discharge assembly 190 with a cover 154 having a distance between cover 154 folds or bends 201 and 202 that is equal to the distance between bottom edges 211 and 212, however, has only passed the require 5 to 1 safety tests 50% of the time. As the distance between a cover 154 folds or bends 201 and 202 becomes shorter than equal, a heat fused bag 10 with a discharge assembly 190 was able to pass the safety 5 to 1 safety lifting requirements.

In the FIBC/bulk bag industry, based on the 5 to 1 safety requirements, a bag that will be carrying 2,000 pounds of material for example, must pass testing with 10,000 pounds of pressure applied, before the bag breaks. To test the bag, the bag is hung from its lift loops and hydraulic pressure is applied from a top of the bag to measure the force needed to break the bag.

In testing, a bag designed to hold 2,000 pounds of bulk material and having a heat fused discharge tube and bottom, and a rolled discharge tube or pinched tube in a closed configuration failed when applying 7,000 pounds of pressure to the bag. When a cover 154 was added to form a discharge assembly 160 or 190, the bag designed to hold 2,000 pounds of bulk material with a heat fused joint connecting a discharge tube and bottom was able to withstand 13,000 pounds of pressure applied to the bag during testing. A cover 154 can thus increase the strength of the bag by over 50%.

In embodiments where a bag comprises sewn seams, a cover 154 is not needed in order for the bag to pass the 5 to 1 safety requirements. A cover 154 is advantageous for a bag with sewn seams to provide additional support and strength to the bag, provide a cleaner bottom surface, and to provide a flatter bottom surface for the bag.

Figure 12:
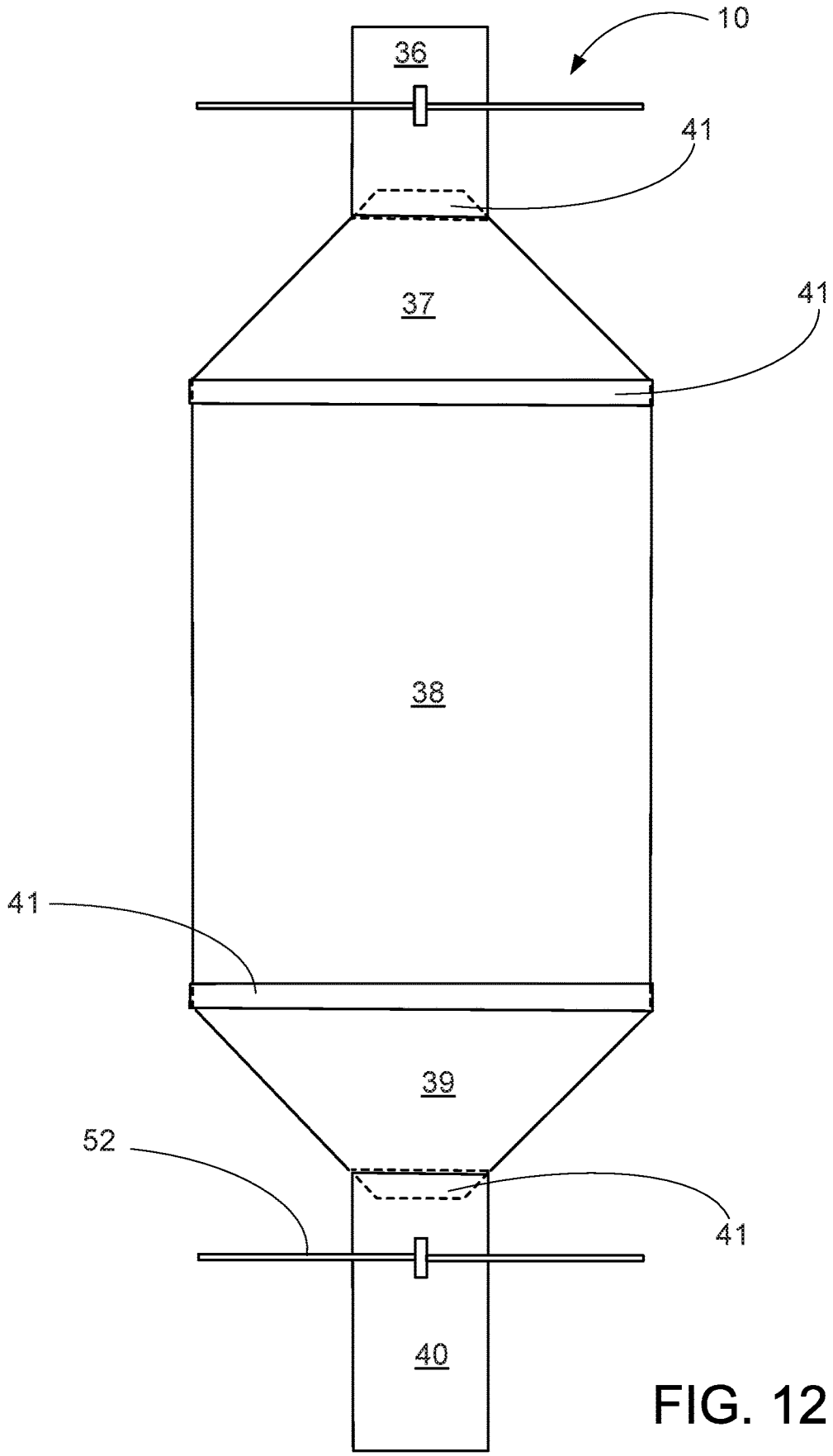
FIG. 12 is a top view of a bulk bag shown folded in a gusseted configuration.
Figure 12A:
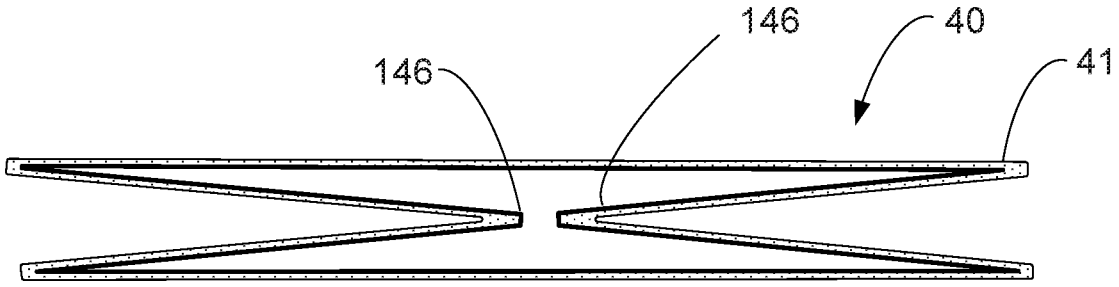
FIG. 12A illustrates an end view of an embodiment of a folded, gusseted fill or discharge spout.
Figure 12B:
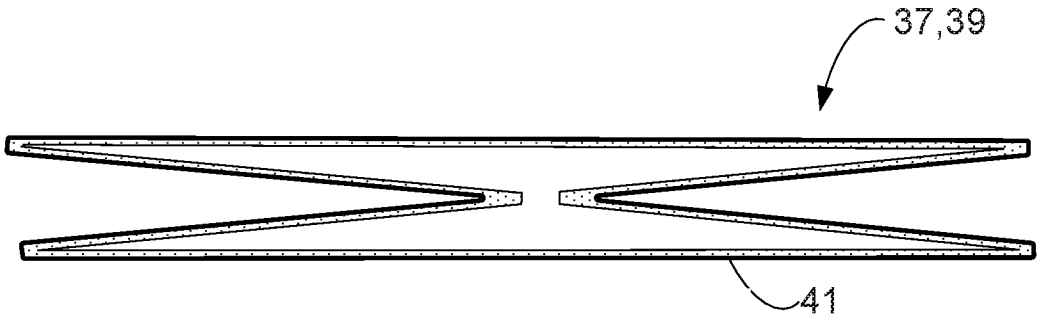
FIG. 12B illustrates an end view of an embodiment of a folded, gusseted top or bottom panel.
Figure 12C:
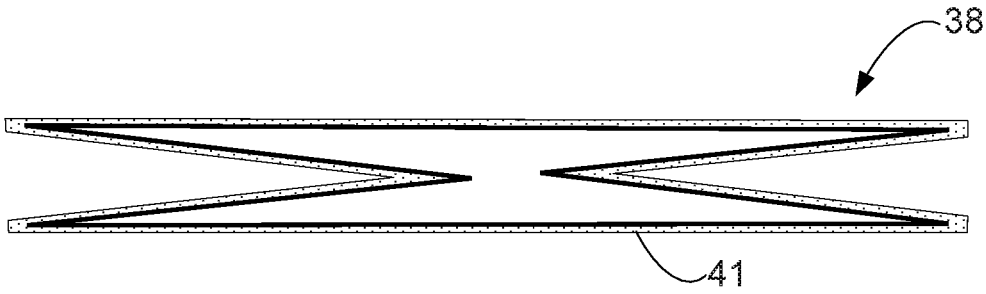
FIG. 12C illustrates an end view of an embodiment of a folded, gusseted bag body.

In FIG. 12, a top view of a bag 200 is shown, in folded, gusseted formation, after it preferably has been pressed to maintain a substantially flat configuration. The discharge tube shown is a rectangular gusseted tube 40. The tube 40 can be pinched closed and tied off with tie 52 to form a closed configuration of a discharge tube assembly 60. To change such a discharge tube assembly 40 from a closed to open configuration, the tie or strap 52 can be untied or otherwise removed.

Alternatively the tie or strap 52 can be removed or not provided on a discharge tube 40 and the tube can be rolled up towards the bottom 39 and coupled thereto in accordance with forming a rolled tube 140 and a closed configuration of a discharge tube assembly 160 as described above. In some embodiments the discharge tube 40 can also be rolled with a strap or tie 52 still positioned on the tube, although preferably the tie or strap 52 is not present in the embodiment of assembly 160.

Figure 13A:
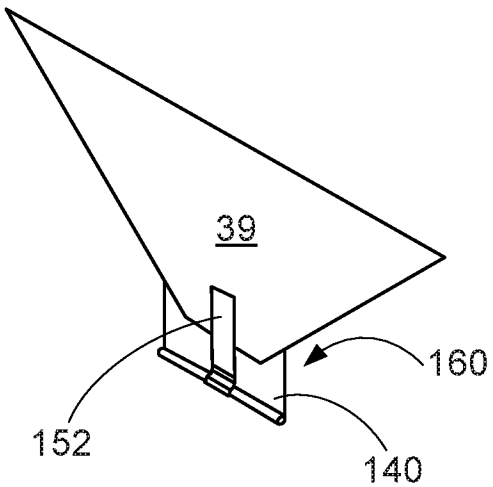
FIG. 13A is a perspective view of a bottom and discharge tube as shown in FIG. 12, but without a tie strap, and depicting the discharge tube in a rolled configuration.

FIG. 13A illustrates a perspective view of the bottom 39 and discharge tube assembly 160 as shown in FIG. 11 in folded, gusseted configuration after the tube has been rolled into a closed configuration. Tape or tie 152 is shown adhered to the bottom 39 and rolled discharge tube 140. FIG. 13B illustrates a front view of the bottom 39 and rolled discharge tube 140 as shown in FIG. 13A.

Figure 13C:
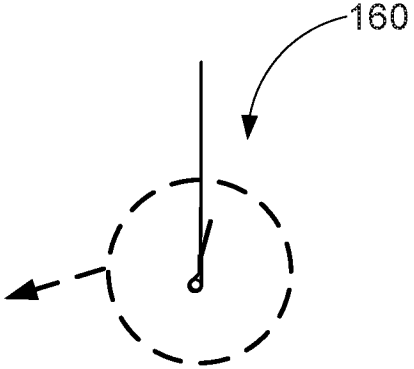
FIG. 13C is a side view of a bottom and discharge tube taken along lines 13D-13D of Figure B.
Figure 13B:
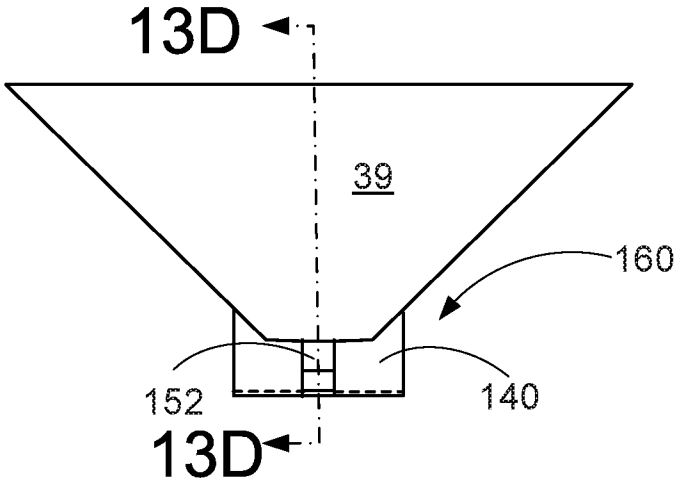
FIG. 13B is a front view of the bottom and discharge tube shown in FIG. 13A.
Figure 13D:
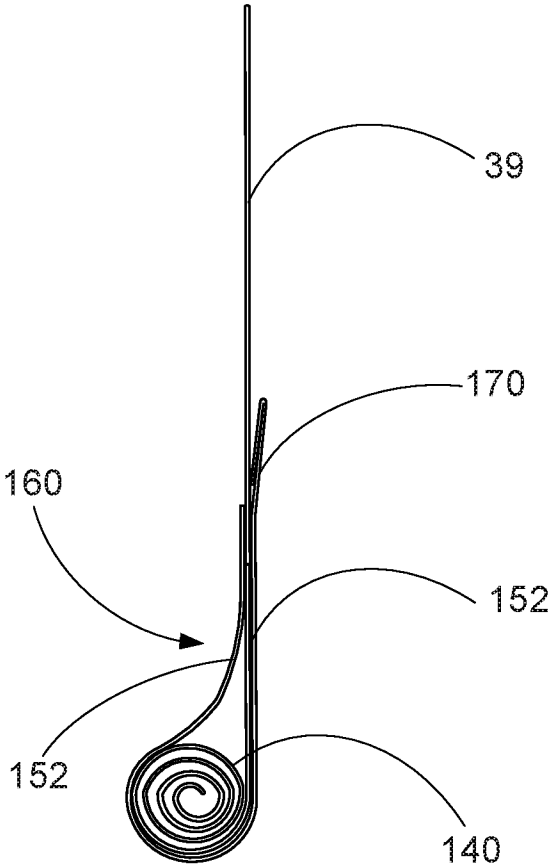
FIG. 13D is an enlarged, detailed view of FIG. 13C.
Figure 14A:
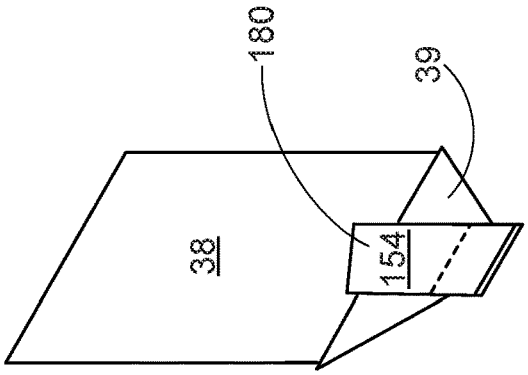
FIG. 14A is a perspective view of a rolled discharge tube, bottom and body panel including an embodiment of a cover over the rolled discharge tube.
Figure 14B:
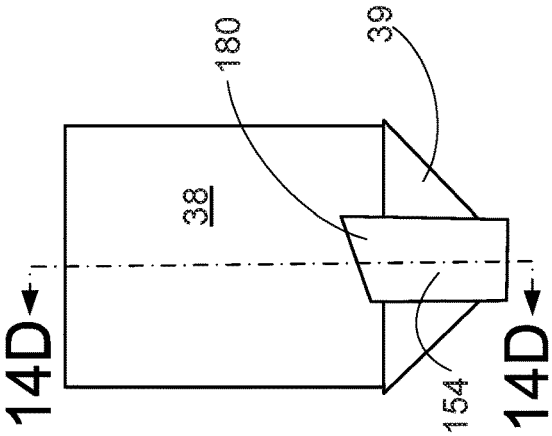
FIG. 14B is a front view of the discharge tube, bottom, and body panel shown in FIG. 14A.
Figure 14C:
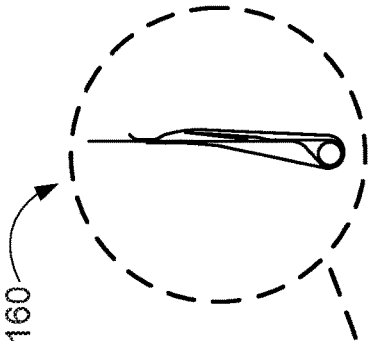
FIG. 14C is a side view of the discharge tube, bottom, and body panel taken along lines 14D-14D of FIG. 14B.
Figure 14D:
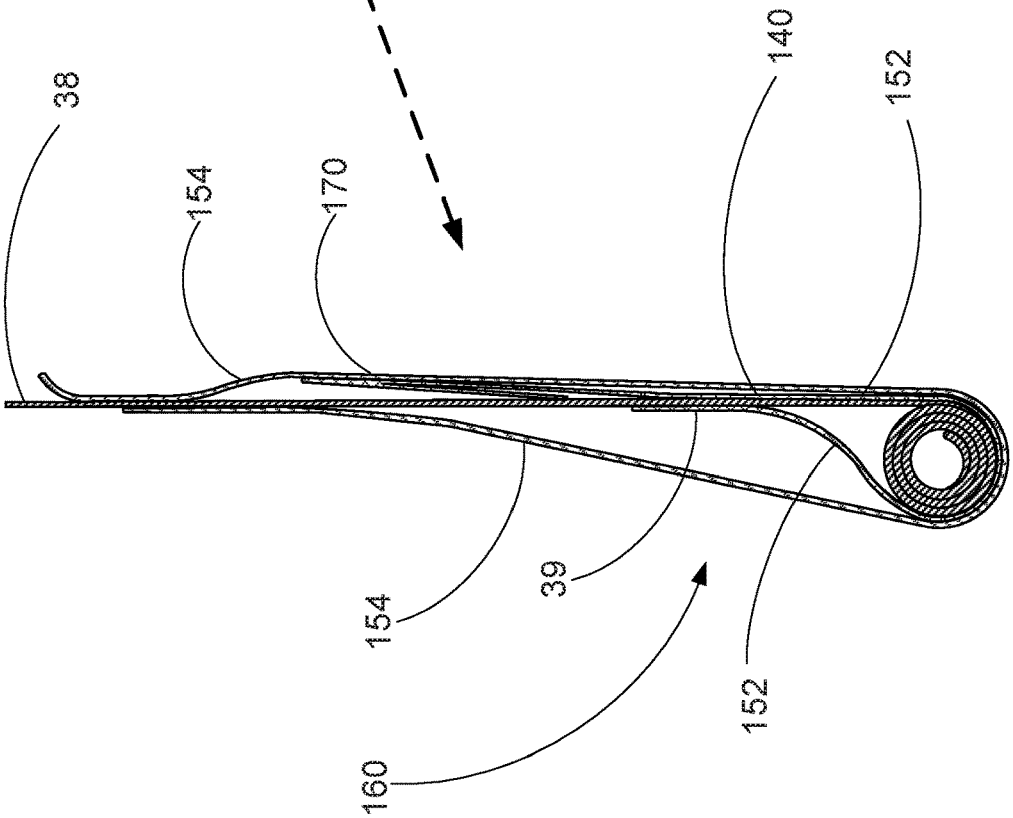
FIG. 14D is an enlarged, detailed view of FIG. 14C.

FIGS. 13C and 13D illustrate a side view of the bottom 39 and rolled spout 140. As shown tape 152 is adhered to bottom 39 and rolled discharge tube 140 and extends from the bottom 39 to under and around the rolled layers 148 of the discharge tube 140 and to a back side of the discharge tube 140. The non-adhered portion 170 of tape 152 provides a pull tab, which when pulled will release the rolled layers 148. The pull tab 170 can be formed by folding tape 152 back on itself, or by not heat fusing that portion, for example if a heat fusion or heat sealing method is utilized. As described above, alternatively, the tape does not have to be wrapped fully around discharge tube 140, see FIGS. 6-8.

FIGS. 14A-14D illustrate the discharge tube as shown in FIGS. 13A-13D including a cover 154 extending from a front body portion 38 side across the bottom 39 and under the rolled tube 140 to a back body 38 side.

In a preferred embodiment a cover 154, whether used with a rolled discharge spout 140 or tied off spout 40, is preferably adhered to opposing sidewalls of body or intermediate portion 38 via heat fusion to form a bond, e.g., to establish couplings 162, 164. Preferably the cover is attached to the body 38 so that all forces of the material contained within the bag 10 only stresses the cover 154 couplings 162, 164 in a shear position. A tab 180, however, preferably can easily be pulled in a peel position to release the cover 154. Additionally preferably the tie or tape 152 attaching rolled spout 140 after it is rolled up to the bottom 39, is preferably secured/adhered bag bottom 39 so that it is only stressed by material contents in the bag in a shear position and does not release until a tab is pulled in the peel direction, even when subject to the pressure and weight from the material contents in the bag pressing down on it.

The release tab 170 of the tape 152 on spout 140 can also easily be pulled in a peel direction to cause the open configuration of the discharge tube 140 and release the material contents of the bag. With the configuration of the cover 154 and rolled discharge tube 140 as described herein, the couplings or bonds that must support the material contents of the bag have great shear strength, and can withstand the pressure upon them when a bag is filled with 1,000 to 5,000 pounds of material, for example, yet the bonds or couplings 162, 164 or 166 can easily be released by pulling a tab 180 or 170 in the peel direction.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

PARTS LIST

The following is a list of parts and materials suitable for use in the present invention:

| | |
|---|---|
| 10 | bulk bag |
| 19 | coating or lamination |
| 36 | top spout/fill tube |
| 37 | upper portion/top |
| 38 | immediate portion/ body/body portion |
| 39 | lower portion/ bottom/bottom panel |
| 40 | spout |
| 41 | seam or joint |
| 43 | patch |
| 50 | lift loop |
| 52 | spout tie |
| 54 | outer cover |
| 56 | tie or cord |
| 60 | discharge assembly |
| 62 | pinch point |
| 102 | bottom panel |
| 104, 106 | heat sealing or fusion |
| 140 | discharge spout |

-continued

| | |
|---|---|
| 142 | discharge spout |
| 144 | gusset spout |
| 146 | gussets |
| 148 | rolled/stacked layers |
| 152 | coupler/tie/adhesive tape |
| 154 | cover |
| 160 | discharge assembly |
| 162 | coupling |
| 164 | coupling |
| 166 | coupling |
| 168 | tape location |
| 170 | tab |
| 180 | tab |
| 190 | discharge assembly |
| 201 | fold or bend |
| 202 | fold or bend |
| 211 | edge |
| 212 | edge |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A flexible bag comprising:

a body including a first body side and a second body side, wherein the first body side and the second body side are opposing sides;

a bottom panel having an outer periphery, a bottom opening that is at least substantially square, a first bottom edge and a second bottom edge, wherein the first bottom edge and the second bottom edge are opposing edges of the bottom panel; and a discharge assembly comprising:

a discharge spout having a pair of spout openings that are at least substantially square, the discharge spout coupled to the bottom panel at a location that is spaced away from the outer periphery of the bottom panel, the bottom panel coupled to the discharge spout at a heat seal joint, and wherein the discharge spout has a rolled configuration with a plurality of rolled layers held against the bottom panel and an unrolled configuration; and a releasable discharge spout coupler, the releasable discharge spout coupler releasably coupled to the discharge spout in the rolled configuration and to the bottom panel, to maintain the rolled configuration of the discharge spout in position against the bottom panel;

wherein the releasable discharge spout coupler is tape that has a pull tab;

wherein the tape couples the discharge spout in the rolled configuration to the bottom panel and wherein the pull tab is not attached to the bottom panel or to the discharge spout in the rolled configuration;

wherein the tape is positioned on the bottom panel and the discharge spout in the rolled configuration so that the tape is only stressed by material contents in the bag in a shear direction and the tape does not release until the pull tab is pulled in a peel direction;

wherein at least a portion of the discharge spout in the rolled configuration extends downward from, and exterior to, the bottom panel; and a cover that is adapted to cinch and push up against the bottom panel to provide an uplift to the bottom panel, maintain the discharge spout in position, prevent downward movement of the bag, and strengthen the heat seal joint between the bottom panel and discharge spout to provide additional support to the bag;

the cover having a first bend and a second bend, the cover positioned on the bag so that the first bend is positioned at or about at a first connection of the first bottom edge and the first body side and so that the second bend is positioned at or about at a second connection of the second bottom edge to the second body side;

the cover releasably attached via a heat seal bond to each of the first and second sides of the body at a location that is spaced above the first connection and the second connection of the bottom panel and the body; and wherein the cover is positioned at least about centrally across the bottom panel without completely covering the bottom panel, the cover extending from the first body side, across the bottom panel and over the discharge spout in the rolled configuration, and to the second body side.

2. The flexible bag of claim 1 wherein the releasable discharge spout coupler is knot-free.

3. The flexible bag of claim 1 wherein the releasable discharge spout coupler coupled to the bottom of the bag and to the discharge spout in the rolled configuration prevents release of bulk material from the bag.

4. The flexible bag of claim 1 wherein the body has an interior and wherein the discharge spout is in communication with the interior of the body.

5. The flexible bag of claim 1 wherein changing from the rolled configuration to the unrolled configuration is effected by releasing the releasable coupler so that the rolled layers unroll.

6. The flexible bag of claim 1 wherein the cover increases a strength of the bag by one to over fifty percent.

7. The flexible bag of claim 1 wherein the flexible bag is filled with 1 to 2 tons of bulk material and wherein the discharge spout in the rolled configuration prevents discharge of the 1 to 2 tons of bulk material.

8. The flexible bag of claim 1 wherein the flexible bag is operable to hold 1 to 2 tons of bulk material, and the releasable discharge spout coupler of the discharge spout in the rolled configuration is operable to prevent discharge of the 1 to 2 tons of bulk material held within the flexible bag.

9. A flexible bag comprising:

a body including a first body side and a second body side;

a bottom panel having a first bottom edge and a second bottom edge, and a bottom opening that is at least substantially square;

a discharge portion having a pair of at least substantially square discharge openings wherein one of said discharge openings is overlapped with the bottom opening in an overlap portion and wherein the bottom panel and the discharge portion are joined together with a heat seal coupler at a heat seal joint in the overlap portion; and a cover adapted to cinch the bottom panel of the bag and apply pressure to the bag to maintain the discharge portion in position on the bag and strengthen the heat seal joint of the bottom panel and discharge tube, the cover extending across the discharge portion and the bottom panel without completely covering the bottom panel, wherein the cover extends from the first body side at a first location that is below a first lift loop of the bag, across the bottom of the bag and over the discharge portion to the second body side at a second location that is below a second lift loop of the bag, the cover having a first bend at which the cover extends across the first bottom edge to the first body side and a second bend at which the cover extends across the second bottom edge to the second body side, and wherein a distance between the first bend and the second bend of the cover is shorter than a length of the bottom panel between the first and second bottom edges;

a first heat seal connection connecting the cover to the first body side and a second heat seal connection connecting the cover to the second body side, wherein the first heat seal connection and the second heat seal connection are positioned on the body so that forces of material contained within the bag only stress the first heat seal connection and the second heat seal connection in a shear direction;

at least one tab portion on the cover, wherein the at least one tab portion is not connected to the bag, the at least one tab portion located above the first heat seal connection, and the at least one tab portion adapted to be pulled in a peel direction to release the first heat seal connection; and wherein the shorter distance between the first bend and the second bend of the cover provides an uplift for the bag and increases strength of the bag by at least 50%.

10. A flexible bag comprising:

a body including a first body side and a second body side;

a bottom including a first bottom edge and a second bottom edge, and a bottom opening that is at least substantially square;

a discharge portion having a pair of opposing discharge openings that are each at least substantially square; and a cover that covers the discharge portion, maintains the discharge portion in position, pushes the discharge portion up against the bottom, strengthens a heat seal connection between the bottom and discharge portion, and provides additional strength to the bag, the cover extending from the first body side, across the bottom of the bag and over the discharge portion to the second body side, the cover having a first bend at which the cover extends across the first bottom edge to the first body side and a second bend at which the cover extends across the second bottom edge to the second body side, and wherein a distance between the first bend and the second bend of the cover is shorter than a length of the bottom between the first and second bottom edges;

wherein the shorter distance between the first bend and the second bend of the cover provides an uplift to the bottom and increases the strength of the bag; and wherein the distance between the first bend and the second bend is one to two inches shorter than a length of the bottom between the first and second bottom edges.

11. The flexible bag of claim 10 wherein the cover coupled to the bag across the discharge portion provides a substantially flat bottom surface for a filled bag, wherein when the bag is in a position to be filled the cover is under the discharge portion and the cover provides a surface for making contact with another surface, the cover causing the discharge portion to push up against the bottom of the bag and raising a portion of the bottom of the bag, while at least a portion of the discharge portion remains exterior to the bottom.

12. The flexible bag of claim 10 wherein the discharge portion includes a closed configuration wherein the discharge portion is rolled towards a bottom of the bag to provide a plurality of rolled layers and wherein the rolled layers are coupled to the bottom of the bag with a releasable coupler.

13. The flexible bag of claim 11 wherein the discharge portion includes a closed configuration wherein the discharge portion is rolled towards a bottom of the bag to provide a plurality of rolled layers, wherein the rolled layers are coupled to the bottom of the bag with a releasable coupler, and wherein the cover pushes the discharge portion up against the bottom of the bag while the discharge portion is in the closed configuration.

14. A discharge assembly for a flexible bag comprising:

a discharge tube coupled to a bag bottom and in communication with a bag interior;

the discharge tube having a closed configuration and an open configuration, and a pair of discharge openings that are at least substantially square, and the bottom having a bottom opening that is at least substantially square, wherein the bottom opening is overlapped with one of said discharge openings at an overlap portion and wherein the discharge tube is coupled to the bag bottom at the overlap portion at a heat seal joint; and a cover that applies pressure to the bag to maintain the discharge tube in position and strengthen the heat seal joint between the bag bottom and the discharge tube, the cover extending from a first bag side, across the bag bottom and discharge tube in the closed configuration, to an opposing second bag side, the cover having a first bend at which the cover extends across a first bottom edge of the bag bottom to the first bag side and a second bend at which the cover extends across a second bottom edge of the bottom edges to the opposing second bag side, and wherein a distance between the first bend and the second bend of the cover is shorter than a length of the bottom between the first and second bottom edges;

a first heat seal connection connecting the cover to the first bag side and a second heat seal connection connecting the cover to the second bag side, wherein the first heat seal connection and second heat seal connection are positioned on the bag so that forces of material contained within the bag only stress the first heat seal connection and the second heat seal connection in a shear direction; and wherein a free end of the cover above the first heat seal connection defines a tab portion that is adapted to be pulled in a peel direction to release the first heat seal connection.

15. The discharge assembly of claim 14 wherein the discharge assembly is rolled in the closed configuration.

16. A flexible bulk bag comprising:

a) a body having a first body side and a second body side, wherein the first body side and the second body side are opposing sides;

b) a bottom that is coupled to the body at a bottom coupler, the bottom having a bottom opening that is at least substantially square;

c) a discharge tube having a pair of discharge tube openings that are each at least substantially square, wherein one of said discharge tube openings is overlapped with the bottom opening at an overlap portion, and wherein the discharge tube is coupled to the bottom with a heat seal coupler at a discharge tube joint at the overlap portion, and wherein the discharge tube has an open configuration and a closed configuration; and d) a cover releasably coupled at a first heat seal joint to the first body side and releasably coupled at a second heat seal joint to the second body side, wherein the cover extends from the first body side, across the bottom and the discharge tube in the closed configuration and to the second body side, and wherein the first heat seal joint and the second heat seal joint are spaced above the bottom coupler;

wherein the cover cinches the bottom and pushes the discharge tube in the closed configuration up against the bottom, providing support for the discharge tube joint and additional strength to the bag.

17. The flexible bag of claim 16 wherein the cover has a first bend where it extends from the first body side to the bottom and a second bend where it extends from the second body side to the bottom, and wherein a distance between the first bend and the second bend is shorter than a width of the bottom.

18. The flexible bag of claim 16 wherein the cover has a first bend where it extends from the first body side to the bottom and a second bend where it extends from the second body side to the bottom, and wherein a distance between the first bend and the second bend is the same as a width of the bottom or less than a width of the bottom.

19. The flexible bag of claim 17 wherein the distance between the first bend and the second bend is up to 2 inches shorter than a width of the bottom.

20. The flexible bag of claim 17 wherein the distance between the first bend and the second bend is up to 4 inches shorter than a width of the bottom.

* * * * *